US009770916B2

(12) United States Patent
Koganehira et al.

(10) Patent No.: US 9,770,916 B2
(45) Date of Patent: Sep. 26, 2017

(54) LIQUID CONSUMPTION APPARATUS

(71) Applicant: SEIKO EPSON CORPORATION, Tokyo (JP)

(72) Inventors: Shuichi Koganehira, Nagano (JP); Ryohei Ito, Nagano (JP); Masaki Tsukida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/048,336

(22) Filed: Feb. 19, 2016

(65) Prior Publication Data

US 2016/0279963 A1 Sep. 29, 2016

(30) Foreign Application Priority Data

Mar. 23, 2015 (JP) ..... 2015-059176
Dec. 1, 2015 (JP) ..... 2015-234474

(51) Int. Cl.
*B41J 2/175* (2006.01)
*B41J 29/38* (2006.01)
*B41J 29/13* (2006.01)

(52) U.S. Cl.
CPC ..... *B41J 2/17566* (2013.01); *B41J 2/17513* (2013.01); *B41J 2/17553* (2013.01); *B41J 29/13* (2013.01); *B41J 29/38* (2013.01)

(58) Field of Classification Search
CPC ..... B41J 2/17566
See application file for complete search history.

(56) References Cited

U.S. PATENT DOCUMENTS 6,247,803 B1 * 6/2001 Kanaya ..... B41J 2/17553 347/86
2002/0140750 A1 * 10/2002 Yoshiyama ..... B41J 2/17566 347/7
2003/0025743 A1 * 2/2003 Maeda ..... B41J 2/17566 347/7
2005/0110849 A1 5/2005 Mui et al.
2008/0266336 A1 * 10/2008 Maru ..... B41J 2/1752 347/7

(Continued)

FOREIGN PATENT DOCUMENTS

CN 2700105 Y 5/2005
JP 2004-074694 A 3/2004

(Continued)

*Primary Examiner* — Shelby Fidler
(74) *Attorney, Agent, or Firm* — Global IP Counselors, LLP

(57) ABSTRACT

A printer to which an ink tank that contains an ink is fixed and that is configured such that a user can refill the ink tank with the ink includes: a consumption amount calculation unit that calculates a consumption amount of the ink; a storage unit that stores a count value that is updated based on the consumption amount of the ink calculated by the consumption amount calculation unit; a sensor that detect whether or not the ink is present at a predetermined position in the ink tank; and a control unit that executes ink presence/absence detection with the sensor. The ink presence/absence detection is for determining whether or not the ink is present. The control unit resets the count value to an initial value thereof if the control unit executes the ink presence/absence detection and determines that the ink is present.

11 Claims, 11 Drawing Sheets

(56) References Cited

U.S. PATENT DOCUMENTS

| | | | | |
|---|---|---|---|---|
| 2012/0044285 | A1 | 2/2012 | Ogasawara et al. | |
| 2012/0139979 | A1* | 6/2012 | Tokuno | B41J 2/175 347/6 |
| 2013/0321501 | A1* | 12/2013 | Igarashi | B41J 2/175 347/7 |
| 2014/0354719 | A1 | 12/2014 | Yamagata et al. | |
| 2015/0239255 | A1* | 8/2015 | Tsukida | B41J 2/17566 347/7 |
| 2015/0343779 | A1* | 12/2015 | Takagi | B41J 2/1433 347/50 |
| 2016/0271963 | A1* | 9/2016 | Maruyama | B41J 2/17566 |
| 2016/0279962 | A1* | 9/2016 | Ishida | B41J 2/17566 |

FOREIGN PATENT DOCUMENTS

| | | | |
|---|---|---|---|
| JP | 2011-073208 | A | 4/2011 |
| JP | 2012-040822 | A | 3/2012 |

* cited by examiner

LIQUID CONSUMPTION APPARATUS

BACKGROUND

1. Technical Field

The present invention relates to a liquid consumption apparatus.

2. Related Art

An inkjet printer (hereinafter simply referred to as a printer) is known as an example of a liquid consumption apparatus. In a printer, ink, which is an example of a liquid, is contained in an ink tank, which is an example of a liquid container, and printing can be performed by injecting ink from a printing head onto a printing medium such as printing paper. In such a printer, when ink has been consumed and the ink to be injected has run out, an idle injection state occurs. To avoid such a problem, there is a proposal of a printer that performs remaining ink amount management by simulatively counting the amount of the used ink, using a so-called ink dot count method, and that issues a warning indicating that ink has run out, when the count value exceeds a value that corresponds to the capacity of the ink tank (e.g., JP-A-2004-74694).

The printer disclosed in JP-A-2004-74694 displays information to ask the user whether or not the ink tank has been replaced if the open/close cover has been left open for five or more seconds. After the user replaces the empty ink tank with an ink tank that is filled with ink, when the user inputs information indicating that the ink tank has been replaced in response to the information thus displayed, reset processing is executed, which is the processing of resetting the count value corresponding to the amount of ink used.

The printer disclosed in JP-A-2004-74694 is premised on replacement of the ink tank, and no consideration is given to a configuration with which the ink tank, which is fixed to the printer, can be refilled with ink by the user. With a configuration in which the ink tank is designed to be replaced, there is no variation in the initial amount of the ink in the ink tank, and therefore, in the remaining ink amount management, no initial difference occurs between the count value and the actual amount of ink used. In contrast, with a configuration in which the ink tank is designed to be refilled with ink by the user, it is likely that, in ink remaining amount management, the count value and the actual amount of ink used differ from each other because of the user refilling the ink tank with ink before the printer issues a warning indicating that the ink has run out, or because of variations in the initial amount of ink in the ink tank that has been refilled with ink by the user. As a result, although there is ink in the ink tank, there is concern that the printer erroneously issues a warning indicating that ink has run out based on the count value, and the user is inconvenienced.

In addition, the printer disclosed in JP-A-2004-74694 is not provided with a sensor that detects a decrease in the amount of ink remaining in the ink tank. Therefore, there is concern that ink runs out before the printer issues a warning indicating that the ink is running out, and the idle injection state occurs.

SUMMARY

The invention has been achieved in order to address at least some of the above-described problems, and can be realized as any of the following modes or application examples.

Application Example 1 a liquid consumption apparatus according to this application example is a liquid consumption apparatus to which a liquid container that contains a liquid is fixed, and that is configured such that a user can refill the liquid container with the liquid, including: a consumption amount calculation unit that calculates a consumption amount of the liquid; a storage unit that stores therein a count value that is updated based on the consumption amount of the liquid calculated by the consumption amount calculation unit; a sensor that detects whether or not the liquid is present at a predetermined position in the liquid container; and a control unit that executes liquid presence/absence detection with the sensor, the liquid presence/absence detection being for determining whether or not the liquid is present. The control unit executes reset processing if the control unit executes the liquid presence/absence detection before executing the reset processing and determines that the liquid is present. The reset processing is for resetting the count value to an initial value thereof.

With the configuration according to this application example, the liquid consumption apparatus is configured such that the user can refill the liquid container with the liquid, and the liquid remaining amount management is performed by detecting whether or not the liquid is present at the predetermined position in the liquid container, using the sensor in addition to the count value obtained by the dot count method. Therefore, even when a difference occurs between the count value and the actual liquid consumption amount, it is possible to detect a decrease in the remaining liquid amount by using the sensor, and it is therefore possible to further suppress the risk of the occurrence of idle injection, compared to the case in which the remaining liquid amount management is performed by using the count value alone. Also, in the case where the actual amount of the remaining liquid is greater than the amount of the remaining liquid based on the count value because of the user refilling the liquid container with the liquid, the count value is reset to the initial value if the control unit executes liquid presence/absence detection and determines that the liquid is present, even if the user does not perform an input operation. Therefore, an erroneous warning that indicates that the remaining liquid amount is small based on the count value is not issued when the actual remaining liquid amount is sufficient. Consequently, the user can continuously use the liquid consumption apparatus without paying careful attention to, for example, the timing of refilling the liquid container with the liquid, the amount of the refill liquid, and the input operation, and it is possible to reduce the risk of idle injection occurring even under such usage conditions.

Application Example 2

In the liquid consumption apparatus according to the above-described application example, it is preferable that the control unit executes the reset processing if the control unit determines that the liquid is present by executing the liquid presence/absence detection and the count value is greater than or equal to a value that corresponds to a capacity of the liquid container.

With the configuration according to this application example, the control unit executes the reset processing if the control unit determines that the liquid is present by executing the liquid presence/absence detection and the updated count value is greater than or equal to the value that is equivalent to the capacity of the liquid container. It can be assumed that there is a significant difference between the count value and the actual consumption amount if it is determined that the liquid is present despite the estimation based on the count value that an amount of liquid greater than or equal to the capacity of the liquid container has been consumed. In such a case, the reset processing is executed without a user operation, and it is thus possible to prevent an erroneous warning that indicates that the amount of remaining liquid is small based on the count value, despite a sufficient actual amount of the remaining liquid, from being repeatedly issued.

Application Example 3

In the liquid consumption apparatus according to the above-described application example, it is preferable that the liquid consumption apparatus includes a sensor end flag that is set up when the control unit determines that the liquid is not present by executing the liquid presence/absence detection, and the control unit executes the reset processing in a case where: the sensor end flag has been set up; a post-sensor end count value that is based on the consumption amount of the liquid is greater than or equal to a first predetermined value; and the control unit determines that the liquid is present by executing the liquid presence/absence detection. The post-sensor end count value has been counted since the control unit lastly determined that the liquid was present before the sensor end flag was set up.

With the configuration according to this application example, if the sensor end flag has been set up, it means that it has already been determined that the liquid is not present by the execution of liquid presence/absence detection with the sensor. If the post-sensor end count value is greater than or equal to the first predetermined value, and it is determined that the liquid is present by the execution of the liquid presence/absence detection, it can be assumed that the user has refilled the liquid container with the liquid after the sensor end flag was set up. Therefore, the control unit executes the reset processing in such a case, and the count value is reset to the initial value even in the case where the user fails to perform the operation to execute the reset processing. Also, if liquid presence/absence detection with the sensor is executed immediately after it is once determined that the liquid is not present and the sensor end flag is set up, there are cases where the result of the determination as to whether or not the liquid is present changes and the user is confused, for example in the case where the liquid container (the liquid consumption apparatus) is tilted or there are air bubbles in the liquid in the liquid container. Therefore, it is possible to avoid such a change in the determination result by executing liquid presence/absence detection upon consumption of a predetermined amount (the first predetermined value) of the liquid after it is once determined that the liquid is not present.

Application Example 4

In the liquid consumption apparatus according to the above-described application example, it is preferable that the liquid consumption apparatus further includes a user interface unit that includes a display unit that displays a message to the user, the control unit generates first data and outputs the first data to the user interface unit during a period from when the control unit executes the reset processing to when the control unit determines that the liquid is not present by executing the liquid presence/absence detection, the first data being for displaying a first message that prompts the user to check an amount of the liquid remaining in the liquid container, and the user interface unit displays the first message on the display unit based on the first data that is output from the control unit.

With the configuration according to this application example, the first message that prompts the user to check the amount of the remaining liquid is displayed on the user interface unit during the period from when the control unit determines that the liquid is present at the predetermined height and resets the count value to the initial value to when the control unit determines that the liquid is not present by using the sensor. Therefore, it is possible to prompt the user to visually check the amount of the remaining liquid when a difference occurs between the count value and the actual consumption amount of the liquid. Since the first message disappears if the liquid is consumed after the count value is reset to the initial value and the control unit determines that the liquid is not present by using the sensor, the user can confirm that the mechanism for detecting the presence/absence of the liquid with the sensor is properly functioning. Also, even if a failure occurs in the mechanism for detecting the presence/absence of the liquid with the sensor, it is possible to allow the user to notice the failure by visually checking the amount of the remaining liquid.

Application Example 5

In the liquid consumption apparatus according to the above-described application example, it is preferable that the user interface unit is capable of receiving, from the user, an input that indicates the user's intention to refill the liquid container with the liquid, and the control unit executes the reset processing if the control unit determines that the liquid is present by executing the liquid presence/absence detection after the user interface unit receives the input that indicates the user's intention to refill the liquid container with the liquid.

With the configuration according to this application example, the control unit executes liquid presence/absence detection in response to the user interface unit receiving the input that indicates the user's intention to refill the liquid container with the liquid, and executes the reset processing upon determining that the liquid is present. Therefore, the reset processing can be executed any time that is convenient for the user in response to the user inputting, from the user interface unit, information that indicates the user's intention to refill the liquid container with the liquid, and refilling the liquid container with the liquid.

Application Example 6

In the liquid consumption apparatus according to the above-described application example, it is preferable that the liquid consumption apparatus further includes: a user interface unit that includes a display unit and is capable of receiving, from the user, an input that indicates the user's intention to refill the liquid container with the liquid, the display unit displaying a message to the user; and a sensor end flag that is set up when the control unit executes the liquid presence/absence detection and determines that the liquid is not present. In a case where the sensor end flag has been set up; a post-sensor end count value is greater than or equal to a first predetermined value; and the control unit determines that the liquid is not present by executing the liquid presence/absence detection, the control unit stops an operation that consumes the liquid when the post-sensor end count value becomes greater than or equal to a sum of the first predetermined value and a second predetermined value, the post-sensor end count value having been counted since the control unit lastly determined that the liquid was present before the sensor end flag was set up, and being based on the consumption amount of the liquid, and the control unit executes the reset processing and enables the operation that consumes the liquid if the control unit determines that the liquid is present by executing the liquid presence/absence detection after stopping the operation that consumes the liquid and after the user interface unit receives the input that indicates the user's intention to refill the liquid container with the liquid.

With the configuration according to this application example, if the sensor end flag has been set up, it means that it has already been determined that the liquid is not present by the execution of the liquid presence/absence detection with the sensor. If it is determined that the liquid is not present by the execution of the liquid presence/absence detection after the post-sensor end count value becomes greater than or equal to the first predetermine value, it means that the user has not refilled the liquid container with the liquid even though the amount of the remaining liquid is small. In such a case, the operation that consumes the liquid is stopped when the value of difference becomes greater than or equal to the sum of the first predetermined value and the second predetermined value. If the sum of the first predetermined value and the second predetermined value is set to, for example, a value that corresponds to the amount of the liquid that can be consumed during a period from when it is determined that the liquid is not present by the execution of the liquid presence/absence detection with the sensor to when idle injection occurs, it is possible to prevent idle injection occurring after the liquid in the liquid container runs out because the operation that consumes the liquid is stopped when the value of difference becomes greater than or equal to the sum.

Also, with the configuration according to this application example, after the operation that consumes the liquid is stopped, it is possible for the user to reset the count value to the initial value and enable the operation that consumes the liquid if it is determined that the liquid is present by the liquid presence/absence detection in response to the user inputting, from the user interface unit, information indicating the user's intention to refill the liquid container with the liquid, and refilling the liquid container with the liquid. Also, since the count value is reset to the initial value when the liquid container is refilled with the liquid, it is possible to correct the difference between the count value and the actual consumption amount.

Application Example 7

In the liquid consumption apparatus according to the above-described application example, it is preferable that the control unit generates second data and outputs the second data to the user interface unit if the post-sensor end count value is greater than or equal to the first predetermined value and the control unit determines that the liquid is not present by executing the liquid presence/absence detection, the second data being for displaying a second message that prompts the user to refill the liquid container with the liquid, and the user interface unit displays the second message on the display unit based on the second data that is output from the control unit.

With the configuration according to this application example, the second message that prompts the user to refill the liquid container with the liquid is displayed on the user interface unit during a period from when the liquid presence/absence detection is executed and it is determined that the liquid is not present to when the liquid presence/absence detection is executed after the user refilling the liquid container with the liquid and it is determined that the liquid is present. Therefore, it is possible to have the user refill the liquid container with the liquid before the liquid in the liquid container runs out and idle injection occurs.

Application Example 8

In the liquid consumption apparatus according to the above-described application example, it is preferable that the liquid with which the user refills the liquid container is contained in a refill container that is a member that is separate from the liquid consumption apparatus, and an amount of the liquid that can be contained in the liquid container when the post-sensor end count value is greater than or equal to the first predetermined value is greater than or equal to a capacity of the refill container.

With the configuration according to this application example, it is easy to refill the liquid container with the liquid because the refill liquid is contained in a separate refill container. Also, since the amount of liquid that can be contained in the liquid container when the post-sensor end count value is greater than or equal to the first predetermined value is greater than or equal to the capacity of the refill container, it is possible to refill the liquid container with the full amount of the liquid contained in the refill container without causing an overflow by refilling the liquid container with the liquid when the second message that prompts the user to refill the liquid container with the liquid is displayed.

Application Example 9

In the liquid consumption apparatus according to the above-described application example, it is preferable that the control unit executes the liquid presence/absence detection and updates the count value every time a predetermined amount of the liquid is consumed.

With the configuration according to this application example, the liquid presence/absence detection is performed and the count value is updated every time the predetermined amount of liquid is consumed. Therefore, it is possible to know the precise amount of the remaining liquid, and to reliably detect a decrease in the amount of the remaining liquid.

Application Example 10

In the liquid consumption apparatus according to the above-described application example, it is preferable that liquid consumption apparatus further includes a plurality of liquid containers that respectively contain a plurality of types of liquids, the consumption amount calculation unit calculates, for each liquid container, the consumption amount of the corresponding liquid, the storage unit stores the count value for each liquid container, each count value being independently updated based on the consumption amount of the corresponding liquid, the sensor is provided for each liquid container, and the control unit executes the liquid presence/absence detection for each liquid container before resetting the corresponding count value to the initial value thereof.

With the configuration according to this application example, the consumption amount calculation unit calculates, for each of the plurality of liquid containers that respectively contain the plurality of types of liquids, the consumption amount of the corresponding liquid, the storage unit stores the count values, the sensor is provided for each liquid container, and the liquid presence/absence detection is executed for each liquid container. Therefore, it is possible to individually manage the amount of remaining liquid depending on the type of each liquid and the capacity of each liquid container, and to suppress the risk of the occurrence of idle injection.

Application Example 11

In the liquid consumption apparatus according to the above-described application example, it is preferable that the sensor is configured with a pair of electrodes disposed inside the liquid container, and the control unit determines whether or not the liquid is present at the predetermined position in the liquid container based on a value of resistance between the pair of electrodes.

With the configuration according to this application example, the sensor is configured with a pair of electrodes that are disposed inside the liquid container. The resistance between the pair of electrodes differs depending on whether or not both of the pair of electrodes are immersed in the liquid. Therefore, it is possible to determine whether or not the liquid is present at the predetermined position based on the resistance between the pair of electrodes.

Application Example 12

In the liquid consumption apparatus according to the above-described application example, it is preferable that the sensor is configured with: a light-shielding member that is disposed inside the liquid container and moves according to an amount of the liquid in the liquid container; and a light-emitting part and a light-receiving part that are disposed outside the liquid container, and the control unit determines whether or not the liquid is present at the predetermined position in the liquid container based on an intensity of light that is emitted from the light-emitting part and is received by the light-receiving part.

With the configuration according to this application example, the sensor is configured with a light-shielding member that is disposed inside the liquid container and a light-emitting part and a light-receiving part that are disposed outside the liquid container, and the light-shielding member moves according to the amount of the liquid in the liquid container. The intensity of the light emitted from the light-emitting part and received by the light-receiving part differs depending on whether or not the light-shielding member is positioned between the light-emitting part and the light-receiving part. Therefore, it is possible to determine whether or not the liquid is present at the predetermined position based on the intensity of the light received by the light-receiving part.

BRIEF DESCRIPTION OF THE DRAWINGS

The invention will be described with reference to the accompanying drawings, wherein like numbers reference like elements.

DESCRIPTION OF EXEMPLARY EMBODIMENTS

The following describes embodiments of the invention with reference to the drawings. The drawings to be used are scaled or exaggerated as appropriate such that parts to be described can be recognized. In some cases, parts other than constituent elements that are necessary for description may be omitted.

First Embodiment

Primary Configuration of Printer System

Figure 1:
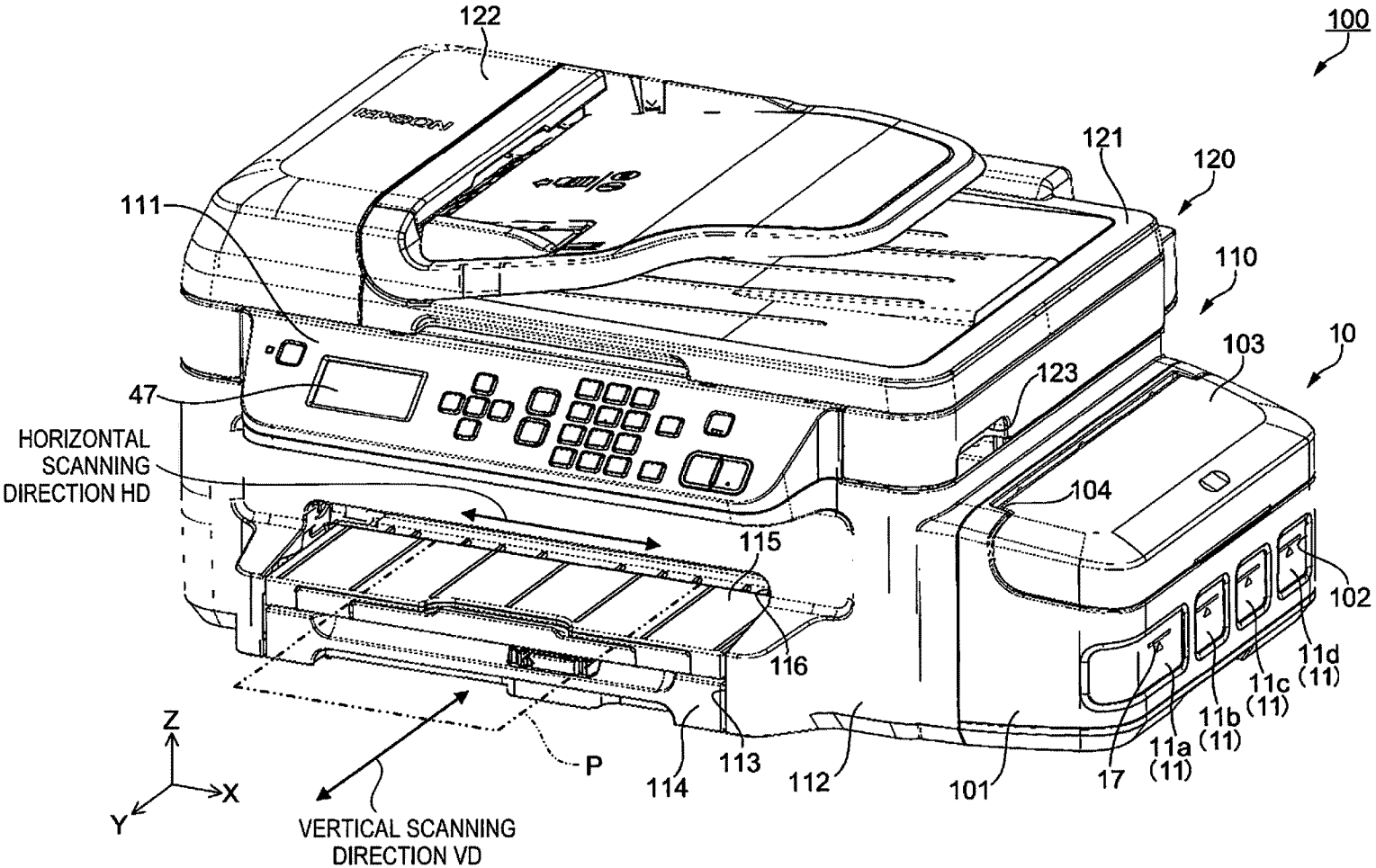
FIG. 1 is a perspective view showing a primary configuration of a printer system according to a first embodiment.

A description is given of a primary configuration of a printer system that includes an inkjet printer (hereinafter simply referred to as a printer) that serves as a liquid consumption apparatus according to a first embodiment with reference to FIG. 1. FIG. 1 is a perspective view showing a primary configuration of the printer system according to the first embodiment. A printer system 100 according to the first embodiment is a multifunction peripheral that is provided with a printer 110, which serves as a liquid consumption apparatus, and a scanner 120.

FIG. 1 shows a Y axis, an X axis that is orthogonal to the Y axis, and a Z axis that is orthogonal to the X axis and the Y axis. For each of the X, Y, and Z axes, the direction of the arrow indicates the + direction (the positive direction), and the direction opposite to the direction of the arrow indicates the − direction (the negative direction). When the printer system 100 is in the usage state, the printer system 100 is disposed on the horizontal plane defined by the X axis and the Y axis, and the +Y direction coincides with the front side of the printer system 100. The Z axis is an axis that is orthogonal to the horizontal plane, and the −Z direction coincides with the vertical downward direction.

As shown in FIG. 1, the printer system 100 is provided with the printer 110, the scanner 120, and an ink supply unit 10. The printer system 100 has an operation panel 111 on the front side, which serves as a user interface unit.

For example, buttons and the like for performing operations such as power ON/OFF of the printer system 100, printing by the printer 110, and document reading by the scanner 120, as well as a display unit 47 for displaying the operation status of the printer system 100, messages, and the like, are disposed on the operation panel 111. A reset button with which the user performs reset processing after refilling the ink tank 11 with ink is also disposed on the operation panel 111. Reset processing is described below.

The printer 110 is capable of performing printing onto a printing medium P such as a sheet of printing paper by injection of ink, which is a liquid. The printer 110 has a casing 112. The outer shell of the printer 110 is configured with the casing 112. An opening 113 is provided on the front side of the casing 112. In the opening 113, a paper cassette 114 is detachably attached to the casing 112. A paper discharge tray 115 is provided above (in the +Z direction of) the paper cassette 114 so as to be extendable in the front-rear direction (the +Y direction and the −Y direction).

Although details will be described later, the X axis direction (the +X direction and the −X direction) coincides with horizontal scanning direction HD of a printing head of the printer 110, and the Y axis direction (the +Y direction and the −Y direction) coincides with vertical scanning direction VD of the printer 110. A plurality of printing media P, being stacked, are placed on the paper cassette 114. The printing media P placed on the paper cassette 114 are supplied to the inside of the casing 112 one by one along the vertical scanning direction VD, and are discharged from a paper discharge port 116 along the vertical scanning direction VD after undergoing printing by the printer 110 and are placed on the paper discharge tray 115.

The scanner 120 is placed on the printer 110. The scanner 120 has a casing 121. The outer shell of the scanner 120 is configured with the casing 121. The scanner 120 is of a flatbed type, and has a document platform (not shown in the drawings) that is formed with a transparent plate-like member made of glass or the like, and an imaging device (not shown in the drawings) such as an image sensor. The scanner 120 can read, as image data, images or the like recorded on a medium such as a sheet of paper via the imaging device.

An upper edge portion of the scanner 120 is provided with an auto document feeder 122. Due to the auto document feeder 122, it is possible to read a plurality of stacked documents (sheets of paper on which an image or the like has been recorded) while reversing the documents and sequentially feeding the documents one by one. The scanner 120 is configured to be rotatable relative to the printer 110, and also serves as a covering of the printer 110. The user can rotate the scanner 120 relative to the printer 110 by raising the scanner 120 upward with his/her fingers inserted in a handle 123. It is thus possible to move up the scanner 120 relative to the printer 110.

The ink supply unit 10 is disposed on the side of the printer 110 in the +X axis direction. The ink supply unit 10 has the function of supplying ink IK (see FIG. 4B), which is a liquid, to the printer 110. The ink supply unit 10 has a casing 101. A plurality of ink tanks 11, which are liquid containers, are disposed within the casing 101, and a plurality of types of ink IK are separately contained in the plurality of ink tanks 11. In other words, each of the plurality of ink tanks 11 contains a different type of ink IK.

In the present embodiment, there are four ink tanks, 11*a*, 11*b*, 11*c*, and 11*d*. Also, in the present embodiment, four types of ink, namely a black ink and color inks of yellow, magenta, and cyan are adopted. The ink tank 11*a* contains a black ink IKa, and the ink tanks 11*b*, 11*c*, and 11*d* contain color inks IKb, IKc, and IKd (of yellow, magenta, and cyan), respectively (See FIG. 4B).

The ink tanks 11*a*, 11*b*, 11*c*, and 11*d* are disposed so as to line up along the Y axis direction from the front side of the printer 110, and are fixed to the inside of the casing 101. In the following description, when the four ink tanks 11*a*, 11*b*, 11*c*, and 11*d*, and the four types of inks IKa, IKb, IKc, and IKd are not distinguished from each other, they are simply referred to as the ink tank 11 and the ink IK.

In the present embodiment, a configuration is adopted in which the ink IK can be injected into the inside of each of the four ink tanks 11 from the outside of the printer system 100. Therefore, the user of the printer system 100 can inject the ink IK contained in another container to the ink tank 11 and refill the ink tank 11. Note that the detailed configuration of the ink tank 11 will be described later.

The casing 101 is provided with windows 102 that respectively correspond to the four ink tanks 11. The windows 102 are light-transmissive. Therefore, the user can visually check the four ink tanks 11 via the windows 102. The windows 102 may be provided as openings that are formed in the casing 101, or configured with a light-transmissive member.

A portion of each ink tank 11 that faces the corresponding window 102 is light-transmissive. Therefore, the user can visually check the amount of the ink IK in each of the four ink tanks 11 via the corresponding window 102. Each ink tank 11 is provided with an upper limit mark 17 at a portion that faces the corresponding window 102. The upper limit mark 17 indicates an approximate upper limit of refilling so that the ink IK does not overflow from the ink tank 11 when the user injects the ink IK. Also, the user can see the amount of the ink IK in each ink tank 11 with reference to the corresponding upper limit mark 17.

In the present embodiment, the capacity of the ink tank 11*a* is greater than the capacities of the ink tanks 11*b*, 11*c*, and 11*d*. The capacities of the ink tanks 11*b*, 11*c*, and 11*d* are the same. For the printer 110, it is assumed that a greater amount of black ink IKa is consumed compared to the color inks IKb, IKc, and IKd. Therefore, among the four ink tanks 11, the capacity of the ink tank 11*a* that contains the black ink IKa is greater than the capacities of the ink tanks 11*b*, 11*c*, and 11*d* that respectively contain the color inks IKb, IKc, and IKd. The ink tank 11*a* that contains the black ink IKa is disposed on the front side of the printer 110 so that the user can see the remaining amount.

The order from the front side, in which the ink tanks 11*b*, 11*c*, and 11*d* that respectively contain the color inks IKb, IKc, and IKd are disposed, is not particularly limited. In the case where any of the inks IKb, IKc, and IKd, instead of the black ink IKa, is consumed by a greater amount compared to the others, such ink IK may be contained in the ink tank 11*a* with a large capacity.

A covering 103 is provided on an upper portion of the casing 101. The covering 103 engages with the casing 101 via a hinge 104 so as to be rotatable. The four ink tanks 11 can be revealed by opening the covering 103. For example, when injecting the ink IK to the ink tank 11, the user can access the ink tank 11 by rotating and opening the covering 103 upward.

Configuration of Printer

Figure 2:
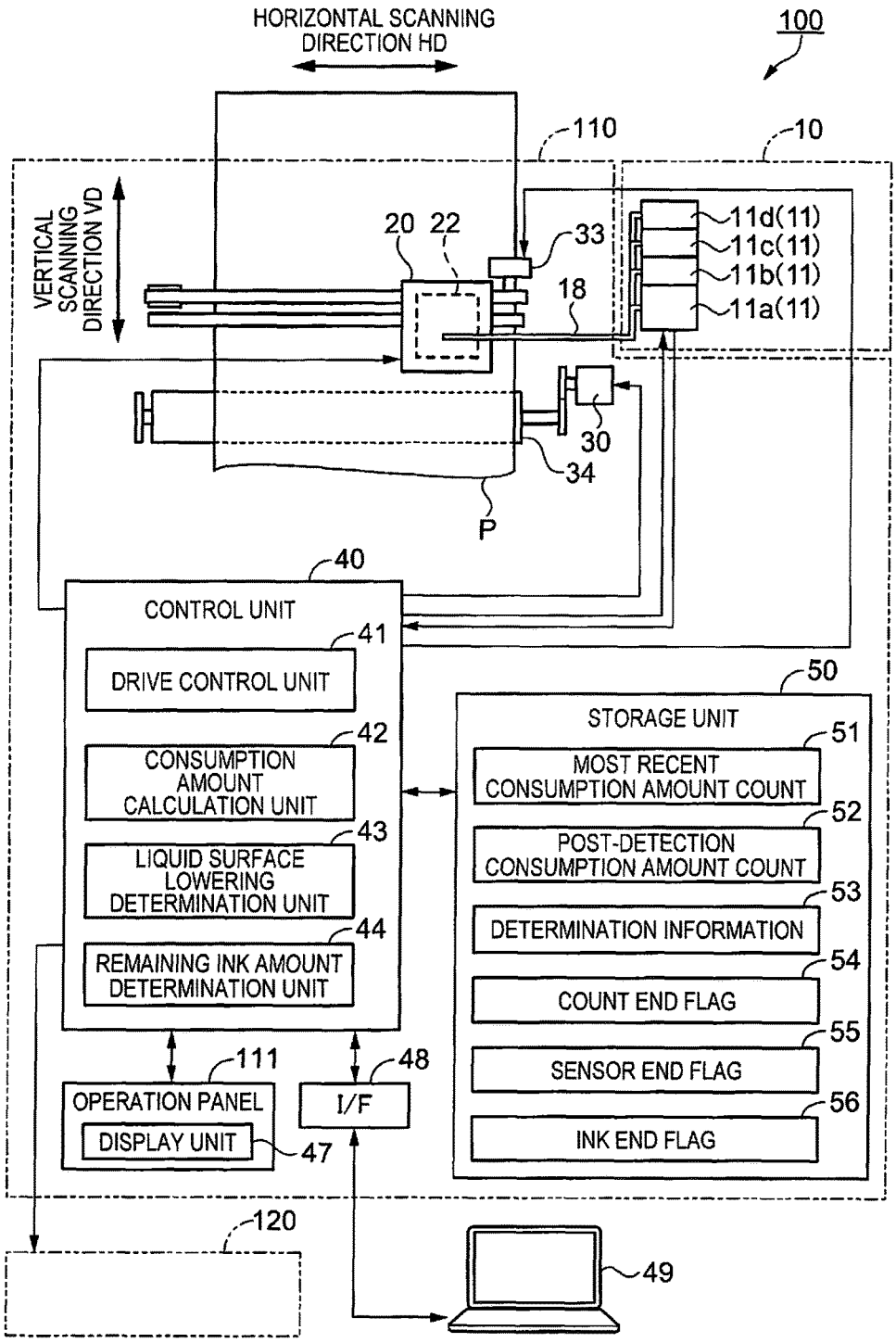
FIG. 2 is a schematic configuration diagram of a printer according to the first embodiment.

Next, a description is given of the configuration of a printer according to the first embodiment with reference to FIG. 2. FIG. 2 is a schematic configuration diagram of the printer according to the first embodiment. As shown in FIG.

2, the printer 110 according to the first embodiment includes a carriage 20, a paper feed motor 30, a carriage motor 33, a paper feed roller 34, a control unit 40, and a storage unit 50. Note that the scanner 120 is omitted from FIG. 2.

A printing head 22 is mounted on the carriage 20. The printing head 22 has a plurality of nozzles that inject the ink IK toward the lower surface side of the carriage 20 (in the −Z axis direction). A tube 18 is provided between the printing head 22 and each ink tank 11. The inks IK in the ink tanks 11 are each conveyed to the printing head 22 via the tube 18. The printing head 22 injects, as ink droplets, the inks IK conveyed from the ink tanks 11, from the plurality of nozzles, onto the printing medium P.

The carriage 20 is connected to the control unit 40 by a cable (not shown in the drawings). The carriage 20 is driven by the carriage motor 33, and thus moves over the printing medium P back and forth along the horizontal scanning direction HD. The paper feed motor 30 rotationally drives the paper feed roller 34, and conveys the printing medium P in the vertical scanning direction VD. Injection by the printing head 22 is controlled by the control unit 40 via the cable.

That is, in the printer 110, the control unit 40 controls the paper feed motor 30, the carriage motor 33, and the printing head 22, and consequently the carriage 20 injects the ink IK from the plurality of nozzles of the printing head 22 to the printing medium P conveyed in the vertical scanning directions VD, while moving along the horizontal scanning directions HD. Printing onto the printing medium P is thus executed.

One end portion of the moving region of the carriage 20 in the horizontal scanning direction HD is a home position region in which that carriage 20 stands by. For example, a cap (not shown in the drawings) for maintenance such as cleaning of the nozzles of the printing head 22 is disposed in the home position region. FIG. 2 shows a situation in which the carriage 20 is positioned in the home position.

Also, for example, a discharge ink box (not shown in the drawings) for receiving ink discharged when flushing, cleaning or the like of the printing head is performed is disposed in the other end portion of the moving region of the carriage 20 in the horizontal scanning direction HD (the end portion that is opposite to the home position). Note that flushing means to inject the ink IK from the nozzles of the printing head 22 during printing onto the printing medium P irrespective of printing. Cleaning means to clean the inside of the printing head by sucking the printing head using a pump or the like provided in the discharge ink box without driving the printing head.

The operation panel 111 including the display unit 47 and serving as the user interface unit is connected to the control unit 40. The user can operate the printer 110 and the scanner 120 via the control unit 40 by operating the operation panel 111.

For example, in FIG. 1, the user sets a document in the auto document feeder 122 of the scanner 120, and then starts operating the printer system 100 by operating the operation panel 111. As a result, the scanner 120 reads the document. Subsequently, based on the image data of the read document, the printing medium P is fed from the paper cassette 114 to the inside of the printer 110 (the casing 112), and the printer 110 performs printing onto the printing medium P.

As shown in FIG. 2, a computer 49 can be connected to the control unit 40 via an interface (I/F) 48. The control unit 40 performs control for receiving image data from the computer 49 via the interface 48 and printing the image onto the printing medium P by using the printer 110 (the printing head 22). The control unit 40 also performs control for reading a document by using the scanner 120, transmitting the image data to the computer 49 via the interface 48, or printing the read image.

The control unit 40 has a drive control unit 41, a consumption amount calculation unit 42, a liquid surface lowering determination unit 43, and a remaining ink amount determination unit 44. The control unit 40 is provided with a CPU, a ROM, a RAM, and so on (not shown in the drawings). The control unit 40, for example, loads, to the RAM, a control program that is contained in the ROM. The CPU executes the control program loaded to the RAM, and serves as each unit of the control unit 40. Alternatively, instead of being provided with a CPU, the control unit 40 may be configured with hardware such as an ASIC (Application Specific IC) that realizes the same functions as the functions executed by the CPU and the control program, or be configured with both the CPU and the ASIC.

The drive control unit 41 controls the carriage motor 33, and performs control for moving the carriage 20. Consequently, the carriage motor 33 drives and moves the printing head 22 of the carriage 20.

The consumption amount calculation unit 42 calculates the amount of ink consumed by injecting the ink IK from the nozzles of the printing head 22. The consumption amount calculation unit 42 starts calculating the ink consumption amount based on the reference amount (initial value) in the situation where the each ink tank 11 is filled with the ink IK. Specifically, when the user presses the reset button after refilling one of the ink tanks 11 with the ink IK, the consumption amount calculation unit 42 initializes the count value of the ink consumption amount for the ink tank 11 (the consumption amount calculation unit 42 restores the initial value. In the present embodiment, the initial value is the count value that indicates an ink consumption amount of 0 g), and starts summing the ink consumption amount. The summation of the ink consumption amount for the ink tank 11 is continued until a count end, which will be described below, or until the user presses the reset button again.

In the printer 110 according to the present embodiment, the remaining ink amount to be displayed on the monitor of the computer 49 is calculated as the amount of ink IK consumed by the printer 110, relative to the weight of ink contained in a single refill bottle provided by the printer vendor. In other words, the remaining ink amount is displayed as the ratio of the ink consumption amount indicated by the most recent ink consumption amount count value, relative to the weight of a single refill bottle (the ink amount that is equivalent to the sum of a predetermined amount C1, a predetermined amount C2, and a predetermined amount C3 shown in FIG. 5, which will be described later (=the ink amount that is equivalent to the sum of the predetermined amount C2, the predetermined amount C3, and a predetermined amount C4)).

The ink consumption amount calculated by the consumption amount calculation unit 42 includes, in addition to the amount of ink consumed by printing onto the printing medium P, the amount of ink consumed for the maintenance of the printing head 22 such as cleaning of the nozzles of the printing head and flushing. The ink consumption amount corresponds to a count value obtained by a so-called dot count method. That is, the cumulative ink consumption amount is calculated by, based on the image data to be printed, multiplying the design ink consumption amount per dot by the number of dots required by the image data to be printed. In the present embodiment, the ink consumption amount is calculated as the amount of the ink IK to be injected from the nozzles of the printing head 22 (the amount of the ink IK per dot×the number of dots to which the ink is injected) for each path along which the carriage 20 performs a single scan.

Also, the ink consumption amount by cleaning and flushing is calculated as the amount of the ink IK that is consumed when cleaning or flushing is performed once. During printing, the amount of the consumed ink is summed every time a predetermined amount (unit consumption amount) of the ink IK is consumed and every time a sheet is discharged, for example, and the count value of the ink consumption amount is stored in the storage unit 50 as the most recent consumption amount count 51. In the case of cleaning or flushing, the count value is stored as the most recent consumption amount count 51 every time.

The state in which the count value of the ink consumption amount has reached a predetermined limitation value is referred to as "count end". Although details will be described later, the predetermined limitation value is the count value of the ink consumption amount that corresponds to the maximum consumable capacity of the ink tank 11. In response to the count value of the ink consumption amount reaching the predetermined limitation value, the control unit 40 sets a count end flag 54 in the storage unit 50.

In the printer 110, although not shown in the drawings, for example when the user performs an operation to execute printing, the approximate amount of the ink IK remaining in each ink tank 11 can be displayed on the monitor (screen) of the computer 49 based on the count value of the ink consumption amount. Therefore, the user can see the approximate amount of the ink IK remaining in each ink tank 11 not only by visually checking through the window 102 corresponding to the ink tank 11 but also on the monitor of the computer 49.

It is also possible to allow a remote user to recognize the amount of remaining ink by outputting the approximate amount of the remaining ink in the ink tank 11 based on the count value, to the computer 49 or an external terminal outside the printer system 100 via wired or wireless communication, and displaying the approximate amount of the remaining ink on the monitor of the computer 49 or the external terminal. Alternatively, a configuration may be adopted in which the approximate amount of the ink remaining in the ink tank 11, based on the count value, is displayed on the display unit 47 of the operation panel 111 of the printer 110.

The liquid surface lowering determination unit 43 performs ink presence/absence detection for each ink tank 11, by which whether or not the ink IK is present at a predetermined position in the ink tank 11, i.e., a predetermined height from the bottom. A sensor 19, which will be described later, is disposed in each ink tank 11 (see FIG. 4B). The sensor 19 is configured with a pair of electrodes 15 and 16. In ink presence/absence detection, the liquid surface lowering determination unit 43 applies voltage to the pair of electrodes 15 and 16, and determines whether or not the ink IK is present at a predetermined height in the corresponding ink tank 11 based on the output signal.

The situation in which the liquid surface lowering determination unit 43 determines that the ink IK is not present at the predetermined height in the ink tank 11 based on the output signal from the pair of electrodes 15 and 16 as a result of the execution of ink presence/absence detection is referred to as "the sensor end". The control unit 40 sets, in the storage unit 50, a sensor end flag 55 for the ink tank 11 for which the sensor end has been detected.

In response to the sensor end flag 55 being set up, the consumption amount calculation unit 42 starts calculating the post-sensor end ink consumption amount, with respect to the ink tank 11 for which the sensor end has been detected. The count value corresponding to the post-sensor end ink consumption amount is updated every time the ink IK is consumed by a predetermined amount (unit consumption amount), and is stored in the storage unit 50 as a post-detection consumption amount count 52.

The count value corresponding to the post-sensor end ink consumption amount is calculated by starting counting from the most recent consumption amount count value that was obtained when the liquid surface lowering determination unit 43 lastly detected the presence of the ink IK at the predetermined height before detecting the sensor end. Therefore, it is possible to reduce the risk of resulting in the actual consumption amount of the ink IK consumed after the sensor end being greater than the count value stored as the post-detection consumption amount count 52. Consequently, it is possible to reduce the risk of idle injection occurring before the remaining ink amount determination unit 44, which will be described later, detects the ink end based on the count value of the post-sensor end ink consumption amount.

Note that instead of calculating the post-sensor end ink consumption amount, the count value at the time it was most recently determined that the ink IK was present at the predetermined height before the detection of the sensor end may be stored as a consumption amount count at the detection, and the value of difference between the consumption amount count at the detection and the most recent consumption amount count 51 may be used as the post-sensor end ink consumption amount.

Ink presence/absence detection is repeatedly executed by the liquid surface lowering determination unit 43 at predetermined timings such as when the printer 110 (the printer system 100) is powered ON, when a print job is received, and before the reset processing described below is executed. Ink presence/absence detection is executed during printing every time a unit consumption amount of the ink IK is consumed.

However, note that the liquid surface lowering determination unit 43 does not execute ink presence/absence detection for the ink tank 11 for which the sensor end was detected and the sensor end flag 55 was set up, until the count value corresponding to the post-sensor end ink consumption amount becomes greater than or equal to a predetermined value A, which will be described later. This is for the purpose of preventing the user from being confused in possible cases where, for example, it is once determined that the ink IK is not present at the predetermined height and then it is determined that the ink IK is present at the predetermined height in the subsequent ink presence/absence detection because of variations in the liquid surface level caused by the printer 110 (printer system 100) being tilted, or because of air bubbles being generated in the ink IK.

The remaining ink amount determination unit 44 determines the remaining ink state of the ink IK in each ink tank 11, based on the count value corresponding to the post-sensor end ink consumption amount, which is stored in the post-detection consumption amount count 52, and determination information that has been set for the corresponding ink tank 11.

The remaining ink state of the ink IK is, for example, an "ink low" state, which indicates that the amount of the remaining ink IK in the ink tank 11 is small, or an "ink end" state, which indicates that there is no consumable amount of ink IK in the ink tank 11. Determination of the remaining ink state of the ink IK is performed based on determination information 53 that is stored in the storage unit 50. The determination information 53 includes a predetermined value A that serves as a first predetermined value for determining the ink low, and a predetermined value B that serves as a second predetermined value for determining the ink end, which are values that are set for each ink tank 11.

The remaining ink amount determination unit 44 determines that the state is the ink low when, after the liquid surface lowering determination unit 43 detects the sensor end of any of the ink tanks 11, the count value corresponding to the post-sensor end ink consumption amount of the ink tank 11 becomes greater than or equal to the predetermined value A.

With respect to the ink tank 11 for which the ink low has been detected, the control unit 40 generates data (second data) for displaying an "ink low notification" (a second message) that notifies the user of a decrease in the amount of remaining ink IK and prompts the user to refill the ink tank 11 with the ink IK, and outputs it to the display unit 47. The display unit 47 displays the ink low notification based on the data. The message for prompting the user to refill the ink tank 11 with the ink IK is continuously displayed on the display unit 47 during a period until the ink end flag 56, which will be described later, is set up, and during a period until the reset processing is executed and the count value is reset to the initial value.

The remaining ink amount determination unit 44 detects the ink end when the count value of the ink consumption amount of the ink tank 11 after the detection of the ink low becomes greater than or equal to the predetermined value B, i.e., when the count value corresponding to the post-sensor end ink consumption amount becomes greater than or equal to the sum of the predetermined value A and the predetermined value B. The control unit 40 sets, in the storage unit 50, the ink end flag 56 with respect to the ink tank 11 for which the ink end has been detected.

In response to the ink end flag 56 being set up, the control unit 40 stops the printing operation of the printer 110 in order to avoid the idle injection state in which the ink IK to be injected runs out. The control unit 40 then generates data for displaying an "ink end notification" that notifies the user of running out of the ink IK in the ink tank 11 for which the ink end has been detected, and that prompts the user to refill the ink tank 11 with the ink IK, and outputs it to the display unit 47. The display unit 47 displays the ink end notification based on the data.

Once the ink end flag 56 has been set up and the printing operation has been stopped, the printer 110 does not operate until the reset processing is executed in response to the user pressing the reset button, and the liquid surface lowering determination unit 43 detects that the ink IK is present. After the ink end flag 56 is set up and the printing operation is stopped, the user refills the ink tank 11, for which the ink end has been detected, with the ink IK, and presses the reset button. When the control unit 40 receives, via the operation panel 111, an input indicating that the ink tank 11 has been refilled with the ink IK, the liquid surface lowering determination unit 43 executes ink presence/absence detection. If it is determined that the ink IK is present at the predetermined height, the reset processing is executed, and the printer 110 enters the state of being able to perform the printing operation.

The storage unit 50 stores information therein in a non-volatile and rewritable manner. The storage unit 50 is, for example, configured with a non-volatile memory such as an EEPROM (Electrically Erasable Programmable Read-Only Memory). A configuration may be adopted in which a ROM provided in the control unit 40 also achieves the functions of the storage unit 50. The storage unit 50 includes regions in which the most recent consumption amount count 51, the post-detection consumption amount count 52, and the determination information 53 are respectively stored. The storage unit 50 also includes regions in which the count end flag 54, the sensor end flag 55, and the ink end flag 56 are respectively set up.

As described above, the count value of the most recent consumption amount count 51 is timely updated based on the ink consumption amount calculated by the consumption amount calculation unit 42 for each ink tank 11. If the reset processing is executed in response to the user refilling an ink tank 11 with the ink IK and pressing the reset button, the most recent consumption amount count 51 stored for the ink tank 11 is cleared and is reset to the initial value. The reset processing is to reset the count value of the most recent consumption amount count 51 to the initial value.

The post-detection consumption amount count 52 is timely updated based on the calculation of the ink consumption amount performed by the consumption amount calculation unit 42 for the ink tank 11 for which the sensor end has been detected. If the reset processing is executed in response to the user refilling an ink tank 11 with the ink IK and pressing the reset button, and the liquid surface lowering determination unit 43 detects the presence of the ink IK, the post-detection consumption amount count 52 stored for the ink tank 11 is cleared and is reset to the initial value.

The determination information 53 is information used by the remaining ink amount determination unit 44 to determine the ink low and the ink end of each ink tank 11, and includes the predetermined value A and the predetermined value B described above. The predetermined value A and the predetermined value B are set for each ink tank 11, i.e., for each type of ink IK.

The reset processing is the processing of initializing the count value of the ink consumption amount (resetting the count value to the initial value) after refilling the ink tank 11, for which the ink low or the ink end has been detected, with the ink IK. The reset processing is executed in response to the user pressing the reset button of the operation panel 111. If the reset processing is executed in response to a manual operation by the user, and the liquid surface lowering determination unit 43 confirms the presence of the ink IK by executing ink presence/absence detection, flags that have been set up, from among the count end flag 54, the sensor end flag 55, and the ink end flag 56, are cleared, and the count values stored in the most recent consumption amount count 51 and the post-detection consumption amount count 52 are restored to the initial values. Thus, the ink consumption amount calculation is started.

Note that the reset processing in response to a manual operation by the user may be executed at any time when the user presses the reset button, regardless of the remaining amount (the consumption amount) of the ink and whether or not the count end flag 54, the sensor end flag 55, and the ink end flag 56 have been set up.

In the present embodiment, considering cases where the user forgets to press the reset button even though the user has refilled the ink tanks 11 with the ink IK, "automatic reset processing" is executed in order to clear the count end flag 54 and reset the count values stored in the most recent consumption amount count 51 and the post-detection consumption amount count 52 to the initial values, under particular conditions even in cases where the user does not press the reset button. The automatic reset processing will be described later.

Configuration of Ink Supply Unit

Figure 3:
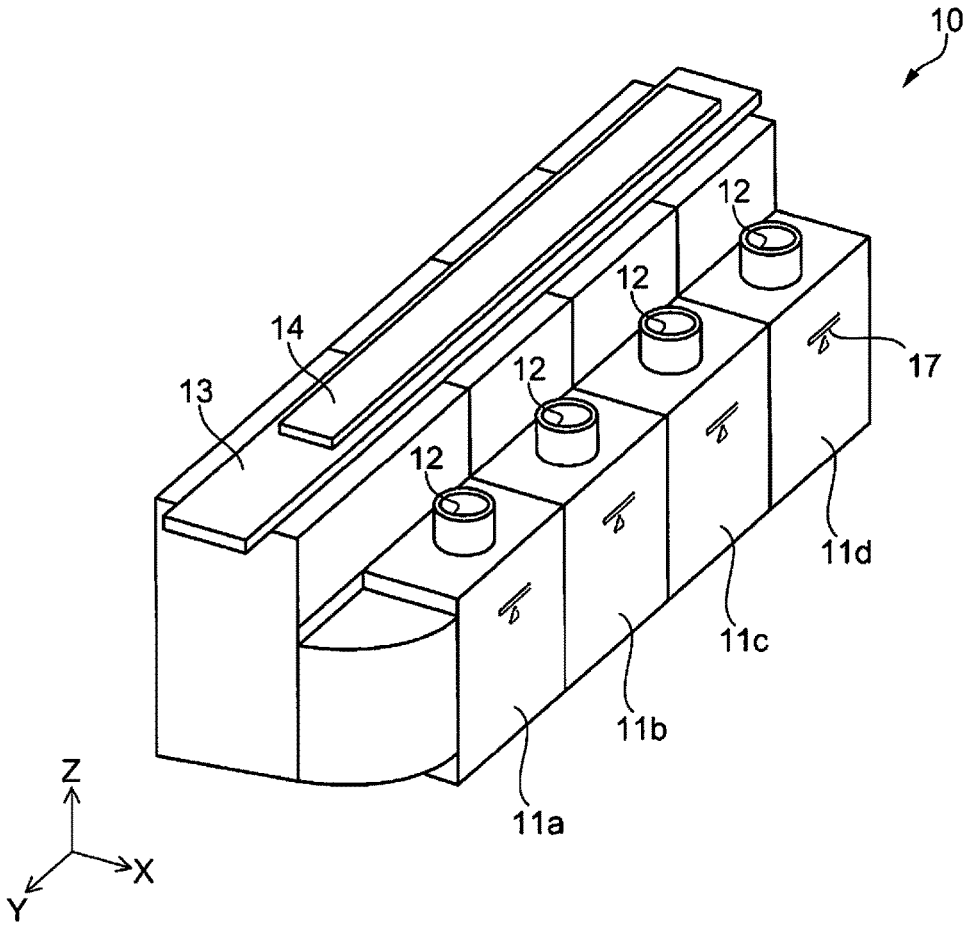
FIG. 3 is a perspective view schematically showing a configuration of an ink supply unit according to the first embodiment.
Figure 4A:
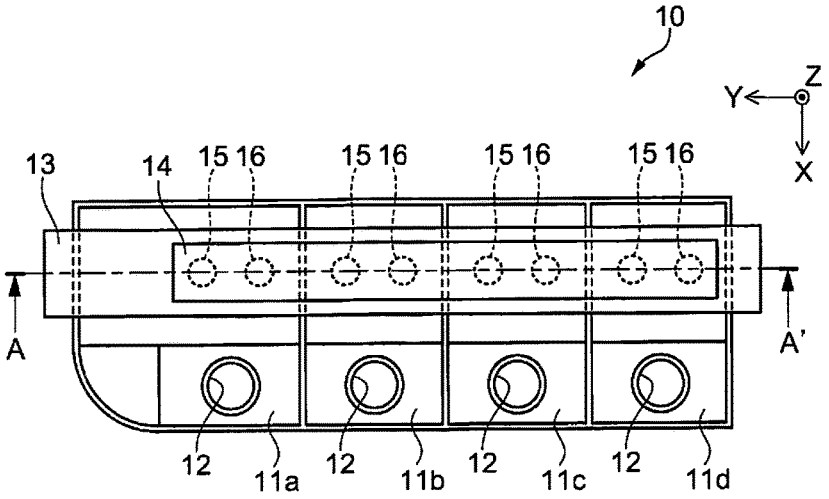
FIG. 4A is a plan view schematically showing the configuration of the ink supply unit according to the first embodiment.
Figure 4B:
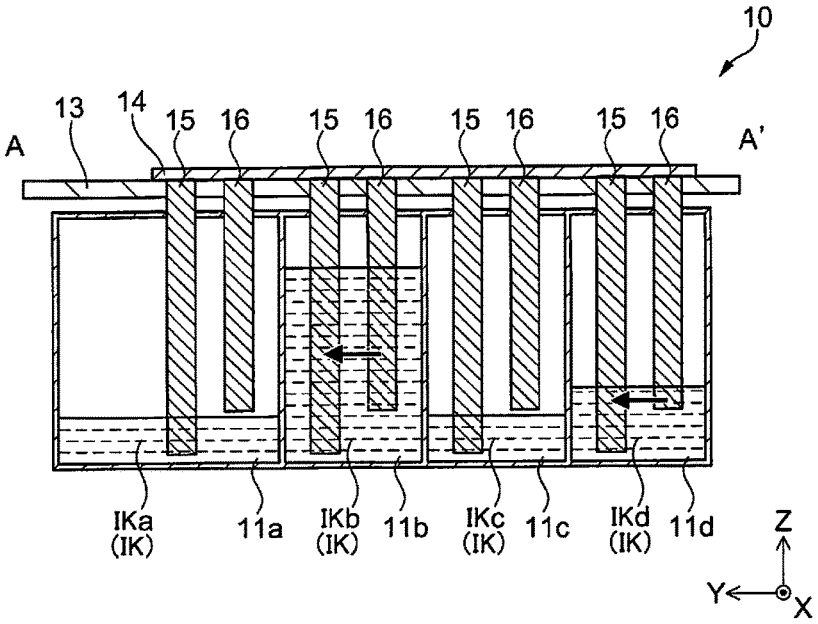
FIG. 4B is a cross-sectional view along a line A-A' in FIG. 4A.

Next, a description is given of the configuration of an ink supply unit according to the first embodiment with reference to FIG. 3, FIG. 4A, and FIG. 4B. FIG. 3 is a perspective view schematically showing the configuration of the ink supply unit according to the first embodiment. FIG. 4A is a plan view schematically showing the configuration of the ink supply unit according to the first embodiment. FIG. 4B is a cross-sectional view along a line A-A' in FIG. 4A. Note that FIG. 3, FIG. 4A, and FIG. 4B each show the ink supply unit 10 shown in FIG. 1 from which the casing 101 has been removed.

As shown in FIG. 3, FIG. 4A, and FIG. 4B, the ink supply unit 10 is provided with the four ink tanks 11*a*, 11*b*, 11*c*, and 11*d*, a holding part 13, a detection substrate 14, and the sensor 19 (the pair of electrodes 15 and 16).

As shown in FIG. 3, the ink tanks 11*a*, 11*b*, 11*c*, and 11*d* are disposed so as to line up along the Y axis direction. The four ink tanks 11 are, for example, formed with synthetic resin such as nylon or polypropylene. The ink tanks 11 may be configured separately from each other or integrally with each other. In the case where the ink tanks 11 are configured integrally with each other, the ink tanks 11 may be formed integrally with each other, or alternatively, the four ink tanks 11 formed separately from each other may be bundled or connected with each other.

In the present embodiment, the upper surface of a portion of each ink tank 11 on the front side (in the +X direction) is lower than the upper surface of a portion thereof on the rear side (in the −X direction). An inlet port 12 for injecting the ink IK from the outside of the printer 110 is provided in the upper surface of the portion of each ink tank 11 on the front side. The user can refill each ink tank 11 with the ink IK of the corresponding color by injecting the ink IK from the inlet port 12. Although not shown in the drawings, the inks IK with which the user refills the ink tanks 11 are each provided in the state of being contained in a refill container (hereinafter referred to as a refill bottle), which is a separate member.

Regarding the ink tanks 11, the Z axis direction, the Y axis direction, and the X axis direction are also referred to as the height direction, the width direction, and the depth direction, respectively. As described above, the capacity of the ink tank 11*a* that contains the black ink IKa is greater than the capacities of the ink tanks 11*b*, 11*c*, and 11*d* that respectively contains the color inks IKb, IKc, and IKd. The ink tank 11*a* and the ink tanks 11*b*, 11*c*, and 11*d* are the same in the height and the depth, but are different in the width. In other words, the width (the length in the Y axis directions) of the ink tank 11*a* is greater than the widths of the ink tanks 11*b*, 11*c*, and 11*d*.

Note that the capacities of the refill bottles each housing the ink IK for refilling by the user vary depending on the types of ink IK. In other words, the capacities of the refill bottles vary depending on the capacity of the ink tank 11 that contains the corresponding ink IK. In the present embodiment, the capacities of the ink tanks 11*b*, 11*c*, and 11*d* that respectively contain the color inks IKb, IKc, and IKd are the same, and accordingly the capacities of the refill bottles that respectively contain the refill color inks IKb, IKc, and IKd are the same. In contrast, the capacity of the ink tank 11*a* that contains the black ink IKa is greater than the capacities of the ink tanks 11*b*, 11*c*, and 11*d*, and accordingly the capacity of the refill bottle that contains the refill black ink IKa is greater than the capacities of the refill bottles that respectively contain the refill color inks IKb, IKc, and IKd.

The holding part 13 that extends along the Y axis direction in which the ink tanks 11*a*, 11*b*, 11*c*, and 11*d* are arranged is disposed above portions of the ink tanks 11 on the rear side. The holding part 13 is fixed to the four ink tanks 11 with a screw, for example. The holding part 13 has the function of holding the detection substrate 14 that is disposed above the holding part 13. The holding part 13 is formed with, for example, insulative synthetic resin or the like. The detection substrate 14 that extends along the Y axis direction in which the ink tanks 11*a*, 11*b*, 11*c*, and 11*d* are arranged is disposed on the holding part 13. The detection substrate 14 is held by the holding part 13.

As shown in FIG. 4A and FIG. 4B, the sensors 19 (the pairs of electrodes 15 and 16) for performing ink presence/absence detection are electrically connected to the detection substrate 14 in one-to-one correspondence with the ink tanks 11. The pairs of electrodes 15 and 16 are connected to the detection substrate 14 via, for example, a spring-like connector, which is not shown in the drawings. In total, four pairs of electrodes 15 and 16, which respectively correspond to the four ink tanks 11, are disposed so as to line up along the direction in which the detection substrate 14 extends. The detection substrate 14 is connected to the control unit 40 via an FFC (Flexible Flat Cable) or the like, which is not shown in the drawings. The outputs of the sensors are thus input to the liquid surface lowering determination unit 43 of the control unit 40.

As shown in FIG. 4B, each pair of electrodes 15 and 16 constituting a sensor 19 is disposed inside the corresponding ink tank 11. The pairs of electrodes 15 and 16 have a longitudinal direction, and they are disposed such that the longitudinal direction extends downward (in the −Z direction) from the detection substrate 14 along the height direction (the Z axis direction) of the ink tanks 11. The pairs of electrodes 15 and 16 are configured with, for example, metal material such as stainless steel.

The electrode 15 in each pair of electrodes has a length with which the lower tip reaches a position that is close to the bottom of the corresponding ink tank 11. The electrode 16 in each pair of electrodes is shorter than the electrode 15, and has a length with which the lower tip reaches a position at a predetermined height from the bottom of the corresponding ink tank 11. The predetermined height from the bottom, at which the tip of the electrode 16 is positioned, is set to be the same for the four ink tanks 11. The predetermined height is appropriately determined based on, for example, the capacities of the ink tanks 11*a*, 11*b*, 11*c*, and 11*d*, and the consumption amount of each ink IK during a predetermined period of time.

Each pair of electrodes 15 and 16 has the function of detecting whether or not the ink IK is present at the predetermined height in the corresponding ink tank 11. When performing ink presence/absence detection, a voltage is applied across each pair of electrodes 15 and 16 from the control unit 40 (see FIG. 2) via the detection substrate 14. To suppress the deposition of the inks IK, the voltage applied across each pair of electrodes 15 and 16 is preferably an AC voltage.

The detection substrate 14 is provided with an analogue switch (not shown in the drawings) that switches to the ink tank 11 to which the voltage is applied. When the liquid surface lowering determination unit 43 (see FIG. 2) executes ink presence/absence detection, the ink tank 11 to be subjected to the determination is selected by switching the analogue switch. The voltage is applied across the pair of electrodes 15 and 16 that corresponds to the selected ink tank 11.

In FIG. 4B, regarding the ink tank 11*b*, the height of the liquid surface of the ink IKb that is contained in the ink tank 11*b* is greater than or equal to the predetermined height. That is, in the ink tank 11*b*, both of the pair of electrodes 15 and 16 are immersed in the ink IKb. Therefore, a current corresponding to the resistance between the pair of electrodes 15 and 16 flows due to the applied voltage upon execution of ink presence/absence detection for the ink tank 11*b*. Consequently, a signal that is based on the value of resistance between the pair of electrodes 15 and 16 disposed in the ink tank 11*b* is output to the control unit 40 via a detection circuit that is provided in the detection substrate 14. If the ink IK is not present, the value of resistance between the pair of electrodes 15 and 16 is infinite, and if the ink IK is present, the value of resistance depends on the ink IK.

As a result, regarding the ink tank 11*b*, the liquid surface lowering determination unit 43 determines that the ink IKb is present at the predetermined height. Similarly, regarding the ink tank 11*d* that contains the ink IKd whose liquid surface is at a height that is greater than or equal to the predetermined height, a current flows between the pair of electrodes 15 and 16 via the ink IKd due to the applied voltage upon execution of ink presence/absence detection, and consequently the liquid surface lowering determination unit 43 determines that the ink IKd is present at the predetermined height.

In contrast, regarding the ink tank 11*a*, the height of the liquid surface of the ink IKa that is contained in the ink tank 11*a* is smaller than the predetermined height. That is, in the ink tank 11*a*, the electrode 16 is not immersed in the ink IKa. Therefore, no current flows between the pair of electrodes 15 and 16 when a voltage is applied upon execution of ink presence/absence detection for the ink tank 11*a*.

Consequently, regarding the ink tank 11*a*, the liquid surface lowering determination unit 43 detects the "sensor end", which indicates that the ink IKa is not present at the predetermined height. Similarly, regarding the ink tank 11*c* that contains the ink IKc whose liquid surface is at a height that is smaller than the predetermined height, no current flows between the pair of electrodes 15 and 16 when a voltage is applied upon execution of ink presence/absence detection. Consequently, the liquid surface lowering determination unit 43 detects the "sensor end", which indicates that the ink IKc is not present at the predetermined height.

As described above, in the present embodiment, whether or not the ink IK is present at the predetermined height from the bottom of the ink tank 11 can be detected based on whether or not a current flows between the pair of electrodes 15 and 16 that constitute the sensor 19 (i.e. based on the difference between the values of resistance). The liquid surface lowering determination unit 43 repeatedly executes, for each ink tank 11, the determination as to whether or not the ink IK is present at the predetermined height from the bottom, at the predetermined timings as described above.

When the ink IK has been consumed due to printing repeatedly performed by the printer 110 and the liquid surface lowering determination unit 43 performs the determination, if the liquid surface of the ink IK in any of the ink tanks 11 is lower than the predetermined height, the "sensor end", which indicates that the ink IK is not present at the predetermined height, is detected for the ink tank 11.

After the liquid surface lowering determination unit 43 detects the "sensor end", which indicates that the ink IK is not present at the predetermined height, if the liquid surface is further lowered as the ink IK is consumed and the ink IK to be sent from the ink tank 11 to the printing head 22 (see FIG. 2) runs out, the idle injection state occurs. In the present embodiment, in order to avoid the idle injection state, the remaining amount management of the ink IK in the ink tank 11 is performed as described below.

Idea of Remaining Ink Amount Management

Figure 5:
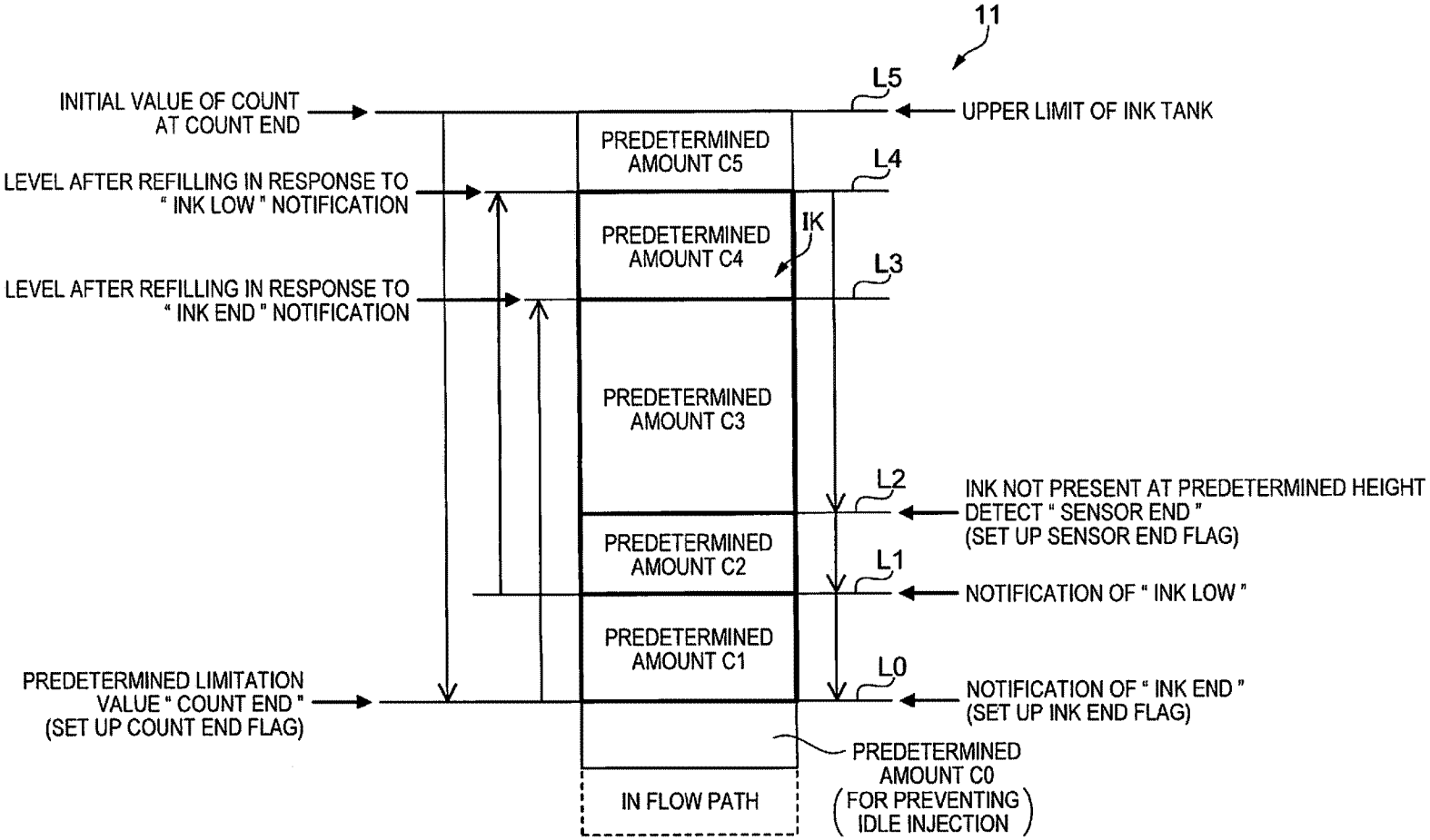
FIG. 5 is a diagram illustrating an idea of remaining ink amount management for ink in an ink tank according to the first embodiment.

A description is given of the idea of remaining ink amount management for the ink IK according to the first embodiment with reference to FIG. 5. FIG. 5 is a diagram illustrating the idea of remaining ink amount management for the ink IK in the ink tank according to the first embodiment. FIG. 5 schematically shows remaining amount levels L0 to L5 of the ink IK in the ink tank 11. In FIG. 5, the vertical direction corresponds to the capacity, and the remaining amount of the ink IK increases from the remaining amount level 0 to the remaining amount level L5 in the upward direction from the bottom.

The remaining amount level L0 is the lowest level of the remaining amount of the ink IK, and is the reference level for the maximum consumable capacity of the ink tank 11. When the remaining amount is at the remaining amount level L0, the "ink end" is detected, which indicates that ink IK is not present in the ink tank 11, and the ink end flag 56 is set up. Then, the ink end notification is displayed to the user, and the printer 110 (see FIG. 2) stops the printing operation.

Note that in order to avoid the idle injection state, a configuration is adopted in which a predetermined amount C0 of ink IK required for the prevention of idle injection is left in the ink tank 11 even when the remaining amount level L0 has been reached. The ink IK is also left in the flow path between the ink tank 11 and the printing head 22 (see FIG. 2). Therefore, the user can consume the ink IK by operating the printer 110 without causing idle injection until the ink IK in the ink tank 11 reaches the remaining amount level L0.

The remaining amount level L1 corresponds to the remaining ink state in which a predetermined amount C1 of ink IK is left until the remaining amount level L0 is reached. The predetermined amount C1 corresponds to the predetermined value B of the count value. That is, the value of difference between the count value at the time the remaining amount level L1 is reached and the count value at the time the predetermined amount C1 of ink IK has been consumed from the remaining amount level L1 and the remaining amount level L0 is reached is the predetermined value B. When the remaining amount is at the remaining amount level L1, the "ink low" is detected, which indicates that the amount of ink IK in the ink tank Ills small, and the ink low notification for prompting the user to refill the ink tank 11 with the ink IK is displayed to the user.

It is required to have the user refill the ink tank 11 with the ink IK before the predetermined amount C1 of ink IK has been consumed since when the remaining amount level is L1 and the remaining amount level L0 is reached. Although it is preferable that refill inks IK are in the user's possession, they can be out of stock. Considering such a situation, a predetermined lead-time period (e.g. one week) for the user to prepare a refill ink IK after the ink low notification is displayed is conceived of, and the amount of each ink IK that can be consumed during the lead time is defined as a predetermined estimated amount C1 (the predetermined value B). Note that the lead time may be set by the printer vendor, based on, for example, the aggregate results of the state of usage of the printer 110 by the printer user.

The remaining amount level L2 is the level corresponding to the predetermined height at which the "sensor end" is detected upon execution of the ink presence/absence detection and for which the sensor end flag 55 is set up. The remaining amount level L2 corresponds to the remaining ink state in which the predetermined amount C2 of ink IK is left until the remaining amount level L1 is reached. The predetermined amount C2 corresponds to the predetermined value A of the count value. That is, the value of difference between the count value at the time the remaining amount level L2 is reached and the count value at the time the predetermined amount C2 of ink IK has been consumed from the remaining amount level L2 and the remaining amount level L1 is reached is the predetermined value A.

As described above, there are cases where it is once determined in ink presence/absence detection that the ink IK is not present at the predetermined height and then it is determined that the ink IK is present at the predetermined height in the subsequent ink presence/absence detection. In order to prevent the user from being confused in such cases, after the sensor end is detected at the remaining level L2, the execution of ink presence/absence detection is suspended until the predetermined amount C2 (predetermined value A) of ink IK has been consumed and the remaining amount level L1 is reached. It is preferable that the predetermined amount C2 is smaller than the predetermined amount C0 for the prevention of idle injection.

The remaining amount level L3 corresponds to the remaining ink state in which the user has refilled the ink tank 11 with the full amount of ink IK that is contained in the refill bottle, in response to the remaining amount level L0 being reached, i.e., in response to the ink end notification being displayed. Therefore, the sum of the predetermined amount C1, the predetermined amount C2, and the predetermined amount C3 is equal to the total amount of the ink IK that is contained in the refill bottle, where the predetermined amount C3 indicates the amount of ink IK that can be consumed from when the remaining amount level is L3 to when the remaining amount level is L2 at which the sensor end is detected.

The remaining amount level L4 corresponds to the remaining ink state in which the user has refilled the ink tank 11 with the full amount of ink IK that is contained in the refill bottle, in response to the remaining amount level L1 being reached, i.e., in response to the ink low notification being displayed. Therefore, the predetermined amount C4 is equal to the predetermined amount C1, and the sum of the predetermined amount C2, the predetermined amount C3, and the predetermined amount C4 is equal to the total amount of the ink IK that is contained in the refill bottle, where the predetermined amount C4 indicates the amount of ink IK that can be consumed from when the remaining amount level is L4 to when the remaining amount level is L3.

The remaining amount level L5 corresponds to the upper limit of the remaining amount of the ink IK. The remaining amount level L5 is the level resulting from adding a predetermined amount C5 as a margin to the remaining amount level 4 in order to prevent the ink IK from overflowing from the ink tank 11 when the user refills the ink tank 11 with the full amount of the ink IK that is contained in the refill bottle in a situation where the remaining amount level is L1.

As described above, the determination and the notification of the ink low is performed based on the comparison between the count value corresponding to the post-sensor end ink consumption amount and the predetermined value A. Here, the ink consumption efficiency of the printer 110 varies depending on the performance tolerance of the printer 110. In a printer with excellent ink consumption efficiency, the amount of consumption of the ink IK actually injected from the printing head 22 and consumed is smaller than the count value that is based on the image data to be printed, and the amount of the ink IK consumed during the period from when the remaining amount level is L2, which indicates the sensor end, until the notification of the ink low is smaller than the predetermined amount C2 (predetermined value A).

If the user refills the ink tank 11 with the full amount of ink IK contained in the refill bottle when the ink low notification is displayed in the case where the actual consumption amount of the ink IK is smaller than the count value, the amount of the ink IK becomes greater (higher) than the remaining amount level L4. In such a case, due to the margin of the predetermined amount C5 for the capacity of the ink tank 11, the ink IK can be prevented from overflowing from the ink tank 11. It is preferable that the predetermined amount C5 is greater than the predetermined amount C2 and smaller than the predetermined amount C0.

With such a configuration, the capacity of the ink tank 11 is greater than the capacity of the refill bottle by the sum of the predetermined amount C4 (or the predetermined amount C1) and the predetermined amount C5. Therefore, in a situation where the ink tank 11 has been refilled with the full amount of the ink IK that is contained in the refill bottle, the user can consume the ink IK of at least the sum of the predetermined amount C1, the predetermined amount C2, and the predetermined amount C3.

Also, in a situation where the remaining amount level is L5, i.e., the ink tank 11 has been refilled with the ink IK, the user can consume the ink IK of the sum of the predetermined amount C1, the predetermined amount C2, the predetermined amount C3, the predetermined amount C4, and the predetermined amount C5. Therefore, the maximum consumable capacity of the ink tank 11 is the sum of the predetermined amount C1, the predetermined amount C2, the predetermined amount C3, the predetermined amount C4, and the predetermined amount C5.

For the user executing printing and consuming the ink IK, it is preferable to refill the ink tank 11 with the full amount of the ink IK that is contained in the refill bottle, during the period from when the remaining amount of the ink IK reaches the remaining amount level L1, at which the ink low notification is displayed, to when the remaining amount level L0 is reached, at which the ink end notification is displayed and the printing operation stops. It is also preferable that the user executes reset processing every time the user refills the ink tank 11 with the full amount of the ink IK in the refill bottle.

If the user refills the ink tank 11 with the ink IK and executes the reset processing as described above, there will be no large difference between the consumption amount of the ink IK that is based on the count value and the actual consumption amount of the ink IK. Therefore, the approximate remaining amount of the ink IK displayed on the monitor of the computer 49 (see FIG. 2) or the like corresponds to the actual remaining amount of the ink IK.

However, there are various ways of use for the user. For example, the user may repeatedly refill the ink tank 11 with a small amount of the ink IK before the ink low notification is displayed, or may not execute the reset processing (forget to execute the reset processing) even after refilling the ink tank 11 with the ink IK in response to the ink low notification being displayed. In such a case, there will be a difference between the consumption amount of the ink IK that is based on the count value and the actual consumption amount of the ink IK.

Note that the ink remaining amount is displayed based on the ratio of "the count value that is updated every time (the most recent consumption amount count value) to the count value that corresponds to the sum of the predetermined amount C1, the predetermined amount C2, and the predetermined amount C3", where the case in which the ink tank 11 is refilled with a single refill bottle's worth ink when the remaining amount level is L0 is assumed as the referential case. However, after the most recent consumption amount count value has changed from L3 to the count value that corresponds to the predetermined amount C3, the ink remaining amount is displayed in a fixed manner based on the ratio of "the count value that is equivalent to the predetermined amount C3 to the count value that corresponds to the sum of the predetermined amount C1, the predetermined amount C2, and the predetermined amount C3". With this configuration, it is possible to avoid the case where the ink low or the ink end is displayed despite the actual remaining amount being greater than or equal to L2.

Here, an assumption is made that there is a printer having a configuration in which the ink tank 11 can be refilled with the ink IK by the user as in the present embodiment, no sensor for ink presence/absence detection is provided as in the printer disclosed in JP-A-2004-74694, and the ink low and the ink end are detected based on the count value since when counting is started. With such a printer, if the difference between the ink consumption amount based on the count value that is equivalent to the most recent consumption amount and the actual ink consumption amount becomes large, the difference between the ink remaining amount that is estimated based on the count value and the actual ink remaining amount becomes large, and it becomes difficult to precisely determine the ink low and the ink end.

Therefore, when the remaining amount that is estimated based on the count value is smaller than the actual remaining amount, the ink low or ink end warning is erroneously issued based on the count value, despite the ink remaining in the ink tank. This causes inconvenience to the user. Also, when the remaining amount that is estimated based on the count value is greater than the actual remaining amount, the ink end warning is not issued despite the ink not remaining in the ink tank. This causes idle injection.

In the present embodiment, ink presence/absence detection is executed with the sensor (the pair of electrodes 15 and 16), and the sensor end is detected when the ink IK is not present at the predetermined height in the ink tank 11. The ink low is detected when the count value of the consumption amount of the ink IK after the detection of the sensor end becomes greater than or equal to the predetermined value A, and the ink end is detected when the count value after the detection of the ink low becomes greater than or equal to the predetermined value B.

For example, even if the user repeatedly refills the ink tank with a small amount of ink IK and the value of difference between the consumption amount of the ink IK based on the count value and the actual consumption amount of the ink IK becomes large, the ink low and the ink end are detected based on the difference in the count value from when the sensor end was detected. Therefore, in the present embodiment, the ink low and the ink end can be more precisely detected, and the idle injection state is prevented from occurring.

However, if the difference between the consumption amount of the ink IK based on the count value and the actual consumption amount of the ink IK is large, the approximate remaining amount of the ink IK displayed on the monitor of the computer 49 based on the count value differs from the actual remaining amount of the ink IK. Also, if a failure occurs in the mechanism for performing ink presence/absence detection with the sensor and it becomes impossible to detect the sensor end, there is the risk of the idle injection state occurring.

Considering the above problems, in the present embodiment, the count value of the ink consumption amount that is equivalent to the maximum consumable capacity of the ink tank 11 from the remaining amount level L5 to the remaining amount level L0 is defined as the predetermined limitation value, and the state in which the count value reaches the predetermined limitation value is detected as the count end. In terms of the count value, the amount of the ink IK that the user can consume is, at most, the amount counted from when the remaining amount level L5, at which counting is started, to when the count value reaches the predetermined limitation value that corresponds to the maximum consumable capacity of the ink tank 11. Therefore, if the count value exceeds the predetermined limitation value, it is determined that there is a difference between the consumption amount (remaining amount) of the ink IK that is based on the count value and the actual consumption amount (remaining amount) of the ink IK.

When the count value reaches the predetermined limitation value and the count end occurs, the count end flag 54 is set up. Upon the count end flag 54 being set up, the control unit 40 (see FIG. 2) generates, with respect to the ink tank 11 for which the count end flag 54 is set up, data (first data) for displaying a "periodical notification" (a first message), which prompts the user to visually check the remaining amount of the ink IK in the ink tank 11, and outputs the data to the display unit 47 (see FIG. 2). The display unit 47 periodically displays a notification based on the data.

Consequently, when the approximate remaining amount of the ink IK displayed on the monitor of the computer 49 based on the count value is different from the actual remaining amount of the ink IK, it is possible to prompt the user to visually check the remaining amount of the ink IK and have the user notice that the remaining amount of the ink IK displayed on the monitor is different from the actual amount. Also, when a failure occurs in the mechanism for performing ink presence/absence detection with the sensor, it is possible to prompt the user to visually check the remaining amount of the ink IK and have the user notice the failure.

Note that in the present embodiment, as shown in FIG. 4B, the capacity of the ink tank 11*a* that contains the black ink IKa is greater than the capacities of the ink tanks 11*b*, 11*c*, and 11*d*. Therefore, the predetermined amounts C1, C2, C3, C4, and C5, and the predetermined values A and B for the ink tank 11*a* are set to be greater than the predetermined amounts C1, C2, C3, C4, and C5, and the predetermined values A and B for the ink tanks 11*b*, 11*c*, and 11*d*. However, the relative relationship between the capacity of each ink tank 11 and the capacity of the corresponding refill bottle is the same as the above.

Although the predetermined values A and B for the ink tank 11*a* and the predetermined values A and B for the ink tanks 11*b*, 11*c*, and 11*d* are different, the same predetermined height for executing ink presence/absence detection with the sensor 19 (the pair of electrodes 15 and 16) is set from the bottom of each of the ink tanks 11*a*, 11*b*, 11*c*, and 11*d*. Consequently, the sensor 19 (the pair of electrodes 15 and 16) can be used with the ink tank 11*a* and the ink tanks

11*b*, 11*c*, and 11*d* having different capacities in the same manner, and the detection substrate 14 can be easily disposed.

Remaining Ink Amount Management Method

Figure 6:
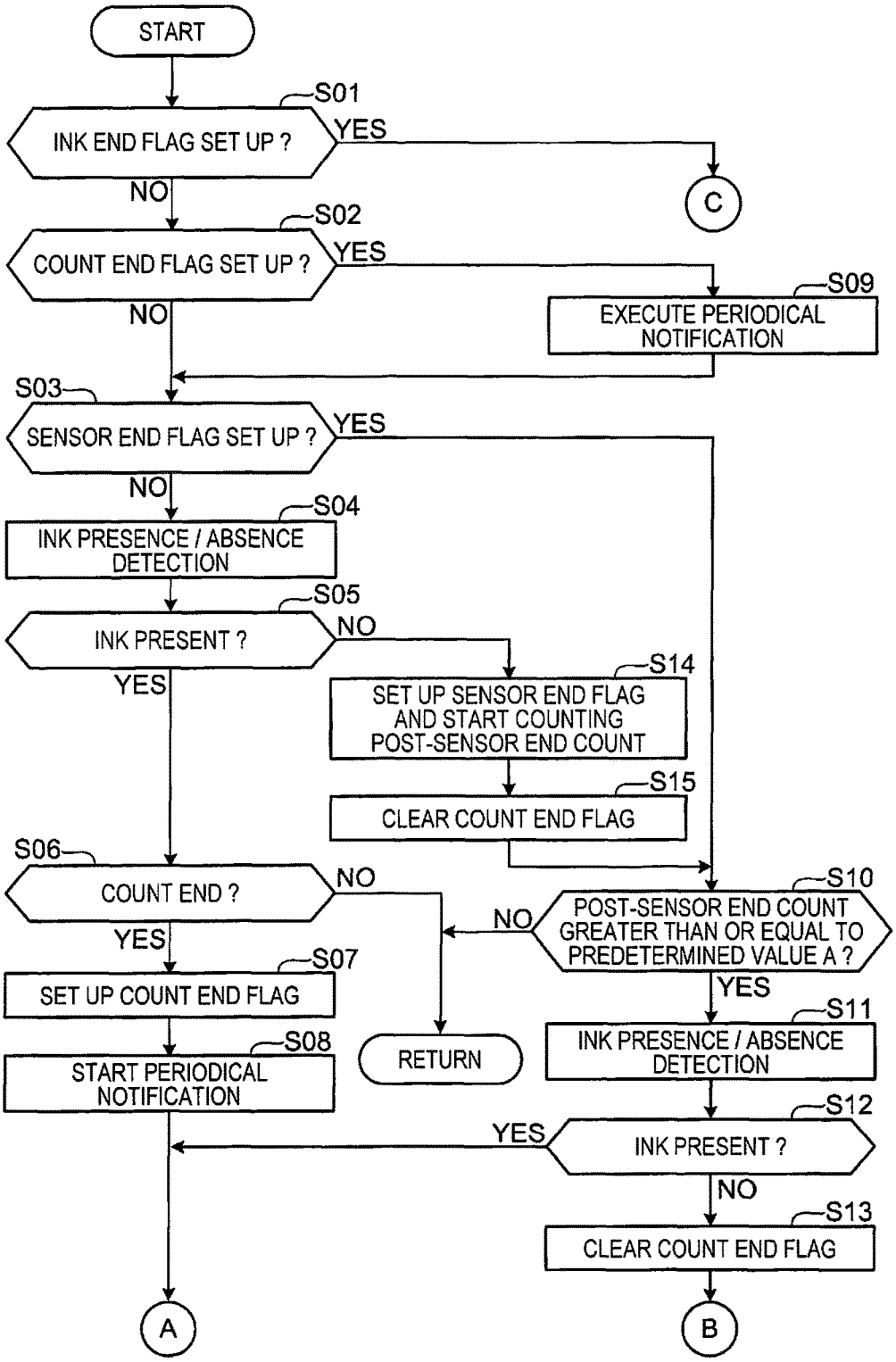
FIG. 6 is a flowchart showing a remaining ink amount management method for the printer according to the first embodiment.
Figure 7:
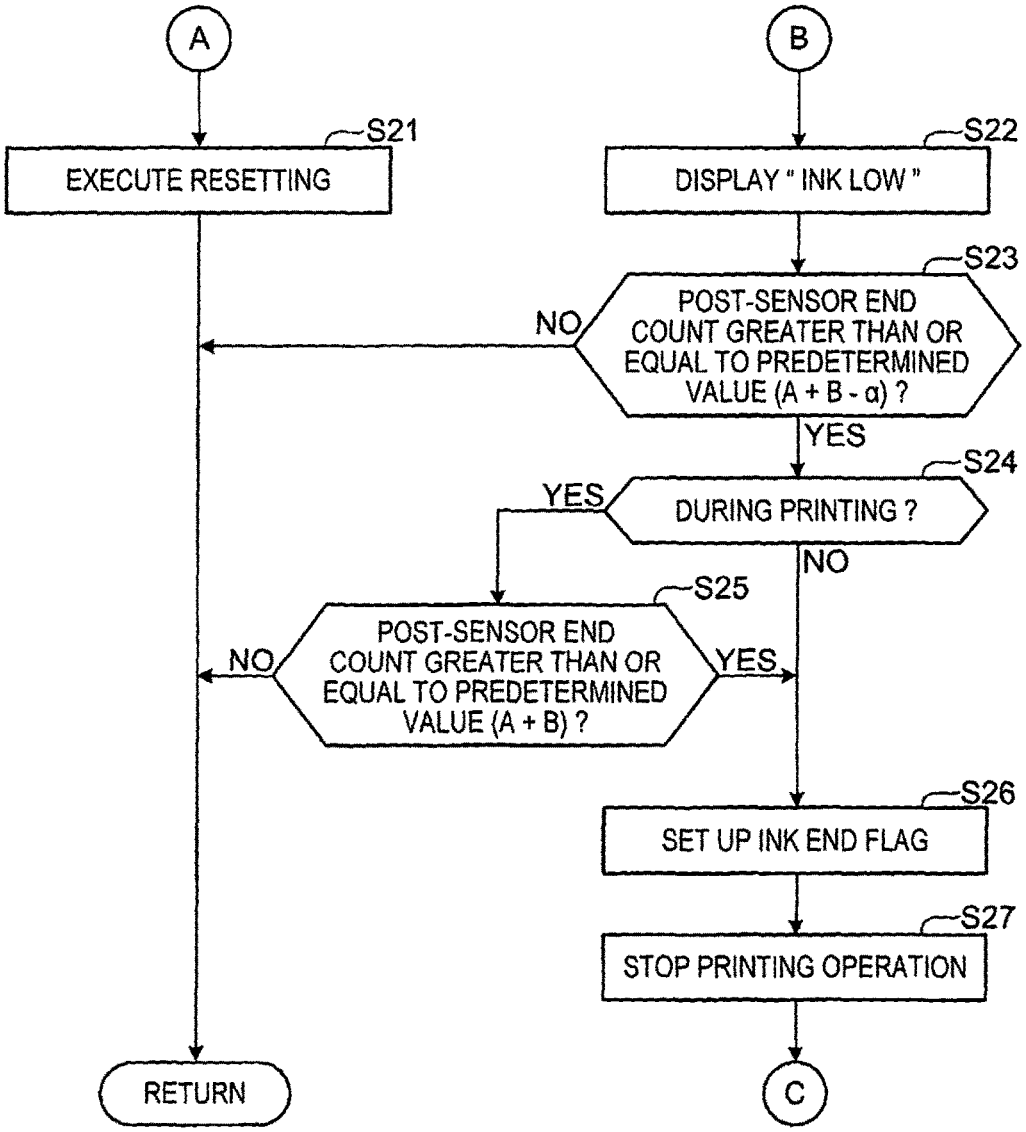
FIG. 7 is a flowchart showing the remaining ink amount management method for the printer according to the first embodiment.
Figure 8:
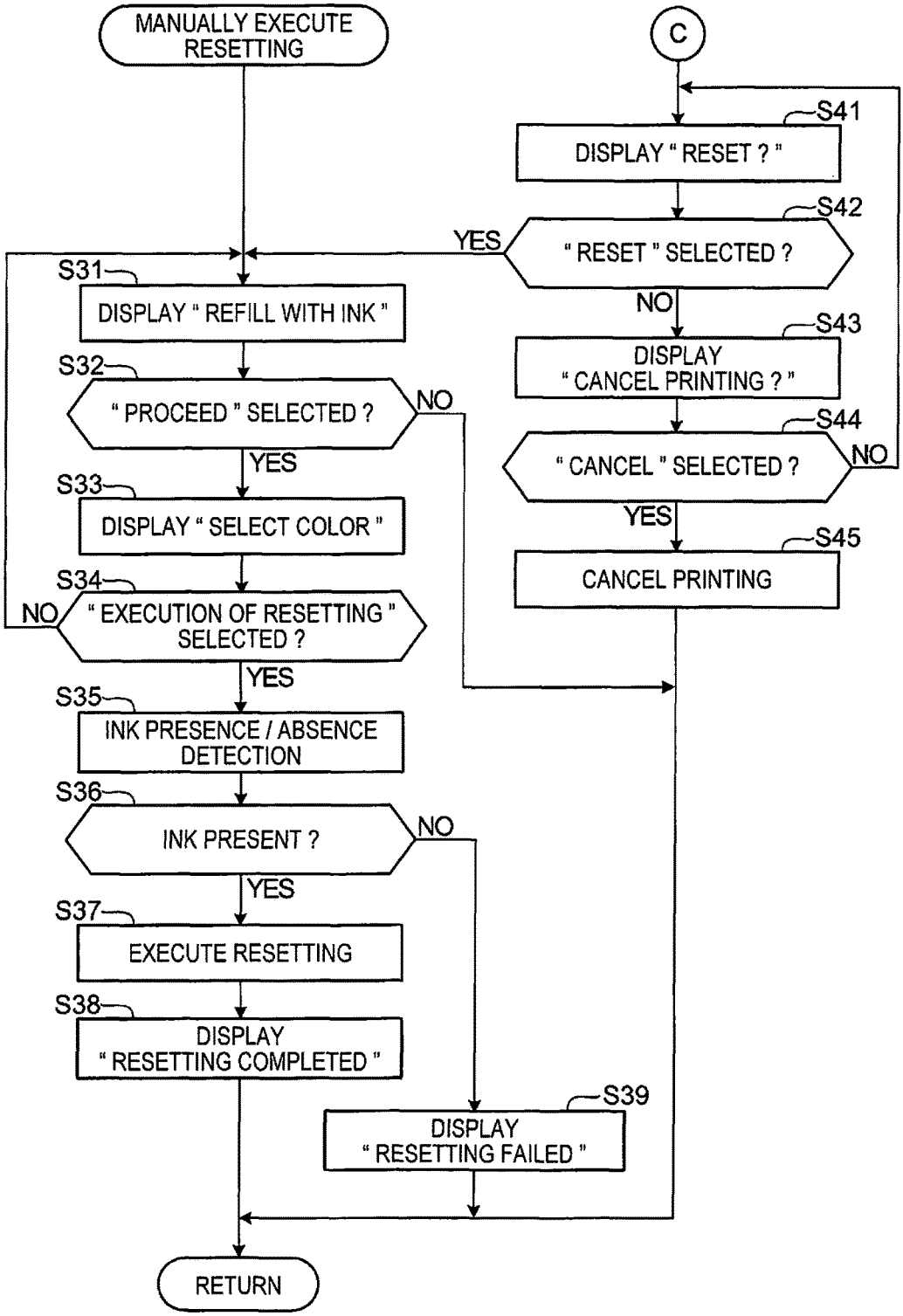
FIG. 8 is a flowchart showing the remaining ink amount management method for the printer according to the first embodiment.

Next, a description is given of a remaining ink amount management method for a printer according to the first embodiment with reference to FIG. 6, FIG. 7, and FIG. 8. FIG. 6, FIG. 7, and FIG. 8 are flowcharts showing the remaining ink management method for a printer according to the first embodiment. Note that in the following description the units included in the control unit 40 of the printer 110 are collectively and simply described as the control unit 40.

In the present embodiment, the processing corresponding to the steps of the flowcharts shown in FIG. 6, FIG. 7, and FIG. 8 is executed when the printer 110 is powered ON, when a print job from the user is received, every time the unit consumption amount of the ink IK based on the most recent consumption amount count value is consumed (every time the value of difference between the current count value and the previous count value equals the unit consumption amount), and when cleaning is performed, for example.

Note that the steps may be executed in an order that has been changed in a given manner, or in parallel, within the scope of not causing a contradiction. Also, the message for prompting the user to make a selection is not limited to the message according to the present embodiment insofar as it does not hinder the control unit 40 from moving ahead to the subsequent step.

Then, the control unit 40 (see FIG. 2) sequentially selects the target ink tank 11 from among the ink tanks 11*a*, 11*b*, 11*c*, and 11*d* (see FIG. 4B), and performs the processing in each step for the selected ink tank 11. The control unit 40 performs the processing in each step for every ink tank 11 provided in the printer 110.

As described above, after the reset processing is performed, the control unit 40 sets the ink consumption amount count, which indicates the ratio of the ink consumption amount based on the capacity of a single refill bottle, to the initial value (ink consumption amount 100%), calculates the ink consumption amount, and stores the most recent consumption amount count 51 calculated for each ink tank 11 to the storage unit 50 (see FIG. 2). The control unit 40 also calculates, for the ink tank 11 for which the sensor end was detected, the post-sensor end ink consumption amount by counting from the count value at the time it was lastly determined that the ink IK was present at the predetermined height before the sensor end was detected, and stores the post-detection consumption amount count 52 calculated for the ink tank 11 to the storage unit 50. The predetermined value A and the predetermined value B for each ink tank 11 is stored in the storage unit 50 as the determination information 53.

First, in step S01 shown in FIG. 6, the control unit 40 determines whether or not the ink end flag 56 has been set up in the storage unit 50. Upon determining that the ink end flag 56 has not been set up (step S01: NO), the control unit 40 proceeds to step S02.

On the other hand, if the control unit 40 determines that the ink end flag 56 has been set up (step S01: YES), it means that the ink end has occurred and the printing operation is in the stopped state. In this case, the control unit 40 proceeds to step S41 shown in FIG. 8, which will be described later, and displays information for prompting the user to execute the reset processing with respect to the ink tank 11 for which the ink end flag 56 has been set up. Note that if the ink end flag 56 has been set up for any of the ink tanks 11, the printer 110 does not enter the state of being able to perform the printing operation until the user executes the reset processing.

In step S02, the control unit 40 determines whether or not the count end flag 54 has been set up in the storage unit 50. Upon determining that the count end flag 54 has not been set up (step S02: NO), the control unit 40 proceeds to step S03.

On the other hand, upon determining that the count end flag 54 has been set up (step S02: YES), the control unit 40 proceeds to step S09 and executes periodical notification, and proceeds to step S03. With the periodical notification in step S09, the first message for prompting the user to visually check the remaining amount of the ink IK in the ink tank 11 is repeatedly displayed on the display unit 47 (see FIG. 2).

As described above, the fact that the count end flag 54 has been set up means that the most recent ink consumption amount count indicates that an amount of ink IK that is greater than or equal to the maximum consumable capacity of the ink tank 11 has been consumed. Therefore, if the count end flag 54 has been set up despite the ink end flag 56 having not been set up (i.e., there is remaining ink IK), it indicates that there is a difference between the most recent consumption amount count value and the actual usage amount of the ink IK, and it is preferable to have the user visually check the remaining amount of the ink IK. Therefore, during the period for which the count end flag 54 is set, periodical notification in step S09 is executed every time the result of determination in step S02 is YES.

Note that in a situation where the count end flag 54 has been set up despite the ink end flag 56 being not set, there can be cases where a failure occurs in the mechanism for performing ink presence/absence detection with the sensor 19 (the pair of electrodes 15 and 16) and the detection circuit, and the absence of the ink IK at the predetermined height in the ink tank 11 cannot be detected. Even in such a case, the user can visually confirm the absence of the ink IK in the ink tanks 11 by visually checking the remaining amount of the ink IK, and consequently recognize the failure in the mechanism for performing ink presence/absence detection.

In step S03, the control unit 40 determines whether or not the sensor end flag 55 has been set up in the storage unit 50. Upon determining that sensor end flag 55 has not been set up (step S03: NO), the control unit 40 proceeds to step S04. On the other hand, upon determining that the sensor end flag 55 has been set up (step S03: YES), the control unit 40 proceeds to step S10, which will be described later.

In step S04, the control unit 40 executes ink presence/absence detection with the sensor 19 (the pair of electrodes 15 and 16). In the subsequent step S05, the control unit 40 determines whether or not the ink IK is present at the predetermined height in the ink tank 11 (the remaining amount level L2 shown in FIG. 5) based on the result of ink presence/absence detection.

Upon determining that the ink IK is present at the predetermined height in the ink tank 11 (step S05: YES), the control unit 40 proceeds to step S06. Upon determining that the ink IK is not present at the predetermined height in the ink tank 11, i.e., upon determining that the state is the sensor end (step S05: NO), the control unit 40 proceeds to step S14, which will be described later.

In step S06, the control unit 40 refers to the most recent consumption amount count 51 stored in the storage unit 50, and determines whether or not the state is the count end, i.e., whether or not the most recent count value has reached the predetermined limitation value. Upon determining that the state is the count end (step S06: YES), the control unit 40 proceeds to step S07. Upon determining that the state is not the count end (step S06: NO), the control unit 40 returns the processing to the start.

In step S07, the control unit 40 sets the count end flag 54 in the storage unit 50 with respect to the ink tank 11 for which the count end was detected. In the subsequent step S08, the control unit 40 starts periodical notification (the first message) in order to prompt the user to visually check the remaining amount of the ink IK in the ink tank 11.

Next, in step S21 shown in FIG. 7, the control unit 40 executes "automatic reset processing" for the ink tank 11 for which the count end flag 54 has been set up. That is, despite the user not executing the reset processing manually, the count value stored in the most recent consumption amount count 51 for the ink tank 11 for which the count end flag 54 has been set up is reset to the initial value. In the case where a transition from step S12 to S21 has occurred, the count value stored in the post-detection consumption amount count 52 is restored to the initial value as well as the count value stored in the most recent consumption amount count 51. Then, the control unit 40 returns the processing to the start. Consequently, the counting of the ink consumption amount for the ink tank 11 for which the count end flag 54 has been set up is resumed.

In the processing up to step S21, in the case where it is determined in step S05 that the ink IK is present at the predetermined height but it is determined in the subsequent step S06 that the state is the count end, it can be determined that there is a difference between the count value and the actual usage amount of the ink IK. Therefore, the control unit 40 sets the count end flag 54 with respect to the target ink tank 11 in step S07, starts the periodical notification in step S08, and restores the count value to the initial value in step S21.

Note that execution of the reset processing in step S21 is not performed based on manual operation by the user refilling the ink tank with the ink IK. Therefore, even after the count value is restored to the initial value by execution of the reset processing, the periodical notification to the user (execution of periodical notification in step S09) is performed until the ink end flag 56 or the sensor end flag 55 is set up, so that the user is prompted to pay attention to the remaining amount of the ink IK.

Returning to FIG. 6, in step S14, for the ink tank 11 for which the sensor end is detected in step S05 (step S05: NO), the control unit 40 sets the sensor end flag 55 in the storage unit 50 and starts counting the post-sensor end consumption amount. The post-sensor end consumption amount count is the count value counted from the most recent consumption amount count value at the time it was lastly determined that the ink IK was present at the predetermined height when the sensor end was detected in step S05, and it is stored in the storage unit 50 as the post-detection consumption amount count 52.

Subsequently, in step S15, if the count end flag 54 has been set up in the storage unit 50 with respect to the ink tank 11 for which the sensor end flag 55 has been set up, the control unit 40 clears the count end flag 54. Then, the control unit 40 stops the periodical notification. As described above, if it is determined in step S02 that the count end flag 54 has been set up, it is possible that there is a difference between the count value and the actual usage amount of the ink IK, or a failure has occurred in the mechanism for performing ink presence/absence detection. Therefore, the control unit 40 executes periodical notification in step S09, and prompts the user to visually check the remaining amount of the ink IK. The fact that the sensor end is thereafter detected in the step S05 means that the mechanism for performing ink presence/absence detection is properly functioning and the remaining amount level L2 of ink IK remains in the target ink tank 11 when detection is performed. Therefore, the most recent consumption amount count value can be corrected based on the actual remaining amount of the ink IK, and the control unit 40 clears the count end flag 54 of the target ink tank 11 in step S15. The control unit 40 then proceeds to step S10. Note that the remaining ink amount after the sensor end flag 55 has been set up is displayed based on the ratio of "the count value that is equivalent to the sum of the predetermined amount C3 and the post-detection consumption amount count 52 to the count value that is equivalent to the sum of the predetermined amount C1, the predetermined amount C2, and the predetermined amount C3". However, after the count value that is equivalent to the sum of the predetermined amount C3 and the post-detection consumption amount count 52 reaches the soft count value that is equivalent to the sum of the predetermined amount C1, the predetermined amount C2, and the predetermined amount C3, the fact that all the amount of ink that corresponds to the weight of a single refill bottle (the ink amount that is equivalent to the sum of the predetermined amount C1, the predetermined amount C2, and the predetermined amount C3 shown in FIG. 5) has been consumed is displayed in a fixed manner with, for example, "ink consumption amount 100%" (or "no remaining ink"). In step S10, the control unit 40 determines whether or not the post-sensor end consumption amount count, i.e., the count value stored in the post-detection consumption amount count 52, is greater than or equal to the predetermined value A. Upon determining that the post-sensor end consumption amount count is greater than or equal to the predetermined value A (step S10: YES), the control unit 40 proceeds to step S11. Upon determining that the post-sensor end consumption amount count is smaller than the predetermined value A (step S10: NO), the control unit 40 returns the processing to the start.

Note that if the post-sensor end consumption amount count is greater than or equal to the predetermined value A, it means that, in terms of the count value, the ink IK in the target ink tank 11 is in the ink low state which is at the level lower than or equal to the remaining amount level L1 shown in FIG. 5. If the post-sensor end consumption amount count is smaller than the predetermined value A, it means that, in terms of the count value, the ink IK in the target ink tank 11 is at the level higher than the remaining amount level L1.

In step S11, the control unit 40 executes ink presence/absence detection with respect to the target ink tank 11 with the sensor 19 (the pair of electrodes 15 and 16). In the subsequent step S12, the control unit 40 determines whether or not the ink IK is present at the predetermined height in the target ink tank 11 based on the result of ink presence/absence detection. Upon determining that the ink IK is not present at the predetermined height (step S12: NO), the control unit 40 proceeds to step S13. Upon determining that the ink IK is present at the predetermined height (step S12: YES), the control unit 40 proceeds to step S21 shown in FIG. 7.

Step S11 and step S12 are performed after step S10 in order to check whether or not the user has refilled the ink tank 11 with the ink IK after the detection of the sensor end in step S04 and S05 and before the ink low notification. Even before the ink low notification is displayed, the user can refill the ink tank 11 with the ink IK at any time. It is also possible that the user does not execute the reset processing with manual operation after refilling the ink tank 11 with the ink IK.

If it is determined in step S12 that the ink IK is present (step S12: YES), an amount of the ink IK greater than the remaining amount level L2 shown in FIG. 5 is present in the target ink 11, and therefore it can be presumed that the user has refilled the ink tank 11 with the ink IK after step S04 and step S05. Therefore, it is obvious that there is a difference between the count value and the actual usage amount of the ink IK, and the control unit 40 proceeds to step S21 and executes the reset processing with respect to the target ink tank 11.

Here, in the case where the control unit 40 proceeds to step S10 after determining in step S03 that the sensor end flag 55 has been set up (step S03: YES), ink presence/absence detection with the sensor is not performed until the post-sensor end consumption amount count becomes greater than or equal to the predetermined value A in step S10. This is, as described above, for the purpose of avoiding once detecting the sensor end by ink presence/absence detection and then determining that the ink IK is present in the subsequent ink presence/absence detection because of the printer 110 being tilted or because of air bubbles in the ink IK.

Regarding the ink tank 11 for which it has been determined in step S12 that the ink IK is not present at the predetermined height (step S12: NO), the control unit 40 clears the count end flag 54 with respect to the target ink tank 11 in step S13 if the count end flag 54 has been set up in the storage unit 50. Then, the control unit 40 stops the periodical notification.

The fact that it is determined in step S12 that the ink IK is not present means that the function of performing ink presence/absence detection is properly functioning, and since the post-sensor end consumption amount count is greater than or equal to the predetermined value A, it can be considered that the ink IK in the target ink tank 11 is in the ink low state. Therefore, the control unit 40 clears the count end flag 54 in step S13. The control unit 40 then proceeds to step S22 shown in FIG. 7.

Although the count end flag 54 is cleared in step S15, clearance of the count end flag 54 is performed in step S13, with consideration of the case in which the count end flag 54 has not been cleared in step S15 due to electrostatic noise or the like. This configuration makes it possible to avoid that the periodical notification is unnecessarily executed in step S09 in cases where the most recent ink consumption amount count coincides with the actual ink consumption amount.

In step S22, the control unit 40 generates the ink low notification (the second data) for prompting the user to refill the ink tank 11 with the ink IK, and outputs the data to the display unit 47. The display unit 47 displays the ink low notification (the second message). Note that if the user refills the ink tank 11 with the full amount of ink IK in the refill bottle when the ink low notification is displayed, i.e., when the ink level reaches the remaining amount level L1 shown in FIG. 5, the ink IK in the target ink tank 11 reaches the remaining amount level L4 shown in FIG. 5.

In step S23, regarding the target ink tank 11, the control unit 40 determines whether or not the post-sensor end consumption amount count, i.e., the count value stored in the post-detection consumption amount count 52, is greater than or equal to a predetermined value (A+B−α). Upon determining that the post-sensor end consumption amount count is greater than or equal to the predetermined value (A+B−α) (step S23: YES), the control unit 40 proceeds to step S24. Upon determining that the post-sensor end consumption amount count is smaller than the predetermined value (A+B−α) (step S23: NO), the control unit 40 returns the processing to the start.

Step 23 is the processing for preventing printing from being suspended (stopped) due to the ink end occurring halfway through a print job when printing is performed based on the user's operation. When the post-sensor end consumption amount count becomes greater than or equal to a predetermined amount (A+B), i.e., when the ink end at the remaining amount level L0 shown in FIG. 5 occurs, the printing operation stops even halfway through a print job in order to avoid the idle injection state. Therefore, in order to prevent the printing operation from being stopped halfway through a print job, it is preferable that the printing operation is stopped just before the ink end, prior to the user performs an operation to execute printing. Note that the predetermined value a is set to be smaller than the predetermined value A and the predetermined value B, and greater than the unit consumption amount of the ink IK for execution of the ink remaining amount management flow.

In step S24, the control unit 40 determines whether or not a print job is being executed. Upon determining that a print job is being executed (step S24: YES), the control unit 40 proceeds to step S25. Upon determining that a print job is not being executed (step S24: NO), the control unit 40 proceeds to step S26.

In step S25, regarding the target ink tank 11, the control unit 40 determines whether or not the post-sensor end consumption amount count, i.e., the count value stored in the post-detection consumption amount count 52, is greater than or equal to the predetermined value (A+B). Upon determining that the post-sensor end consumption amount count is greater than or equal to the predetermined value (A+B), i.e., upon determining that the state is the ink end (step S25: YES), the control unit 40 proceeds to step S26. Upon determining that the post-sensor end consumption amount count is smaller than the predetermined value (A+B) and the state is not the ink end (step S25: NO), the control unit 40 returns the processing to the start.

In step S26, the control unit 40 sets the ink end flag 56 in the storage unit 50 with respect to the target ink tank 11. Then, in step S27, the control unit 40 stops the printing operation of the printer 110, and proceeds to step S41 shown in FIG. 8. Therefore, when the ink end is detected in step S25 during the execution of a print job, the printing operation is stopped halfway through the printing job. If the printing operation is stopped in step S27, the printing operation cannot be started until the user execute the reset processing with manual operation.

In step S41 shown in FIG. 8, the control unit 40 displays a massage saying "EXECUTE RESET PROCESSING?" on the display unit 47, and thus prompts the user to refill the ink tank 11 with the ink IK and execute the reset processing. In step S41, the user can select whether to execute the reset processing (YES) or not execute the reset processing (NO).

In the subsequent step S42, the control unit 40 determines whether or not selection has been made by the user's operation to execute the reset processing. Upon determining that selection has been made to execute the reset processing (step S42: YES), the control unit 40 proceeds to step S31. Upon determining that selection has been made not to execute the reset processing (step S42: NO), the control unit 40 proceeds to step S43.

In step S43, the control unit 40 displays a message saying "CANCEL PRINT JOB?" on the display unit 47, and prompts the user to select whether or not to cancel the print job. In step S43, the user can select whether to cancel (YES) or not cancel (NO) the print job.

In the subsequent step S44, the control unit 40 determines whether or not selection has been made by the user's operation to cancel the print job. Upon determining that selection has been made to cancel the print job (step S44: YES), the control unit 40 proceeds to step S45. Upon determining that selection has been made not to cancel the print job (step S44: NO), the control unit 40 returns the processing to step S41.

In step S45, the print job is cancelled based on the user's selection. The state in which the printing operation by the printer 110 is stopped is maintained during the period from the cancellation of the print job to the execution of the reset processing by the user's manual operation. Note that even in such a state, the printer system 100 can perform document scanning with the scanner 120. Therefore, it is possible to use the scanner 120 even when the refill ink IK is not in the user's possession and the user cannot refill the ink tank 11 with the ink IK.

As described above, upon determining in step S42 that selection has been made to execute the reset processing (step S42: YES), the control unit 40 proceeds to step S31. Also, the reset processing can be manually executed by the user pressing the reset button on the operation panel 111 at the stage of any of the above-described steps. In this case as well, the processing in step S31 is performed.

In step S31, the control unit 40 displays a message saying "PLEASE REFILL WITH INK" on the display unit 47 and prompts the user to refill the ink tank 11 with the ink IK. In step S31, the user can select whether to proceed with refilling with ink (YES) or cancel refilling with ink (NO).

In the subsequent step S32, the control unit 40 determines whether or not selection has been made by the user's operation to proceed with refilling with ink. Upon determining that selection has been made by the user's operation to proceed with refilling with ink (step S32: YES), the control unit 40 proceeds to step S33. Upon determining that selection has been made to cancel refilling with ink (step S32: NO), the control unit 40 returns the processing to the start.

In step S33, the control unit 40 displays a message saying "PLEASE SELECT COLOR" on the display unit 47, and prompts the user to confirm the color of the ink IK and the ink tank 11 to be refilled with the ink IK.

In step S33, the user can select the ink tank 11 to be refilled with the ink IK by selecting the color of the ink IK. If there are a plurality of ink tanks 11 for the inks IK of the same color, the user can select the ink tank 11 to be refilled with the ink IK from among the ink tanks 11. After refilling the selected ink tank 11 with the ink IK, the user can select execution of the reset processing. The user can also make selection to return the processing to step S31.

If the user refills the ink tank 11 with the full amount of the ink IK in the refill bottle in a situation where the printing operation is stopped due to the ink end, i.e., in a situation where the remaining amount level of the ink IK in the ink tank 11 is L0 shown in FIG. 5, the remaining amount level of the ink IK in the ink tank 11 becomes L3 shown in FIG. 5.

In the subsequent step S34, the control unit 40 determines whether or not the target ink tank 11 has been selected and the execution of the reset processing has been selected with the user's operation. Upon determining that selection has been made to execute the reset processing (step S34: YES), the control unit 40 proceeds to step S35. Upon determining that selection has been made to return the processing to step S31 (step S34: NO), the control unit 40 returns the processing to step S31.

In step S35, the control unit 40 executes ink presence/absence detection with respect to the ink tank 11 selected by the user. In the subsequent step S36, the control unit 40 determines whether or not the ink IK is present at the predetermined height in the ink tank 11 selected by the user, based on the result of ink presence/absence detection. Upon determining that the ink IK is present at the predetermined height (step S36: YES), the control unit 40 proceeds to step S37.

In step S37, the control unit 40 executes the reset processing because it has been determined that the ink IK is present at the predetermined height in the ink tank 11 selected by the user and it has been confirmed that the ink tank 11 has been refilled with the ink IK by the user. In step S38, the control unit 40 displays, on the display unit 47, information indicating that the reset processing has completed. Consequently, the ink consumption amount count values stored in the most recent consumption amount count 51 and the post-detection consumption amount count 52 with respect to the ink tank 11 selected by the user are restored to the initial values. Then, the control unit 40 returns the processing to the start. Consequently counting of the ink consumption amount is resumed.

Upon determining in step S36 that the ink IK is not present at the predetermined height (step S36: NO), the control unit 40 proceeds to step S39. If this is the case, it can be assumed that the ink tank 11 has not been refilled with the ink IK by the user, or the ink tank 11 has been refilled with an insufficient amount of ink IK. Therefore, in step S39, the control unit 40 displays, on the display unit 47, information for notifying the user of a failure that has occurred in the reset processing with respect to the target ink tank 11. The state in which the printing operation by the printer 110 is stopped is maintained until the user refills the ink tank 11 with the ink IK and executes the reset processing.

As described above, with the ink remaining amount management method according to the first embodiment, the control unit 40 executes ink presence/absence detection with the sensor 19 (the pair of electrodes 15 and 16) every time a unit consumption amount of ink IK is consumed, and if the predetermined value A of ink IK is consumed after the sensor end is detected, notifies the user by displaying the ink low notification. Therefore, it is unnecessary for the user to be concern about the remaining amount of the ink IK in the ink tank 11 (unnecessary to visually check the remaining amount all the time), and the user can continue printing by refilling the ink tank 11 with the ink IK and executing the reset processing upon the ink low notification being displayed.

Also, it is possible to avoid the idle injection state because if an amount of ink IK that is greater than or equal to the predetermined value (A+B) has been consumed after the sensor end, the ink end notification is displayed to notify the user, and the printing operation of the printer 110 is stopped.

Also, if the user refills the ink tank 11 with the full amount of the ink IK contained in the refill bottle and executes the reset processing when the ink low or the ink end is notified, no significant difference will be generated between the count value and the actual usage amount of the ink IK. Therefore, the user can see the amount of the ink IK remaining in each ink tank 11 from the approximate remaining amount of the ink IK displayed on the monitor of the computer 49 (see FIG. 2) when the user performs the operation to execute printing.

If it does not matter for the user that the approximate remaining amount of the ink IK displayed on the monitor of the computer 49 is different from the actual remaining amount of the ink IK, the user may continue using the printer 110 while adding the ink IK to the ink tank 11 as needed. Even at the count end, the printing operation does not stop if there is the ink IK in the ink tank 11 (if the state is not the ink end), and the user is prevented from being imposed the burden of performing an unnecessary operation. Even if a failure occurs in the mechanism for performing ink presence/absence detection with the sensors, periodical notification is made to prompt the user to visually check the remaining amount of the ink IK, and it is thus possible to have the user notice the failure.

Furthermore, the user can manually execute the reset processing by pressing the reset button on the operation panel 111 at any stage in the remaining ink amount management flow. Therefore, if the user wishes to correct the state in which the approximate remaining amount of the ink IK displayed on the monitor of the computer 49 is different from the actual remaining amount of the ink IK, the user can start the reset processing with manual operation and easily make a correction as needed by refilling the ink tank 11 with the ink IK and executing the reset processing according to information that is displayed on the display unit 47.

Second Embodiment

The second embodiment is different from the first embodiment in that the ink supply unit is provided with, instead of the sensors 19, optical sensors each including a light-emitting part and a light-receiving part, and whether or not the ink is present at the predetermined height in each ink tank is determined based on the intensity of light that is emitted by the light-emitting part and received by the light-receiving part. However, the primary configuration of the printer system and the remaining ink amount management method are the same. The following describes a difference in the ink supply unit from the first embodiment.

Configuration of Ink Supply Unit

Figure 9A:
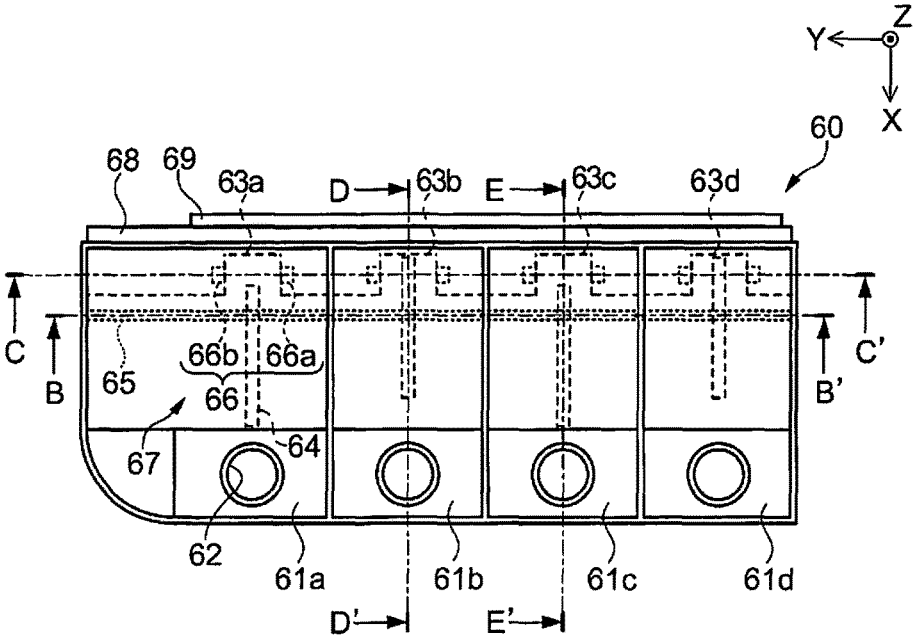
FIG. 9A is a plan view schematically showing a configuration of an ink supply unit according to a second embodiment.
Figure 9B:
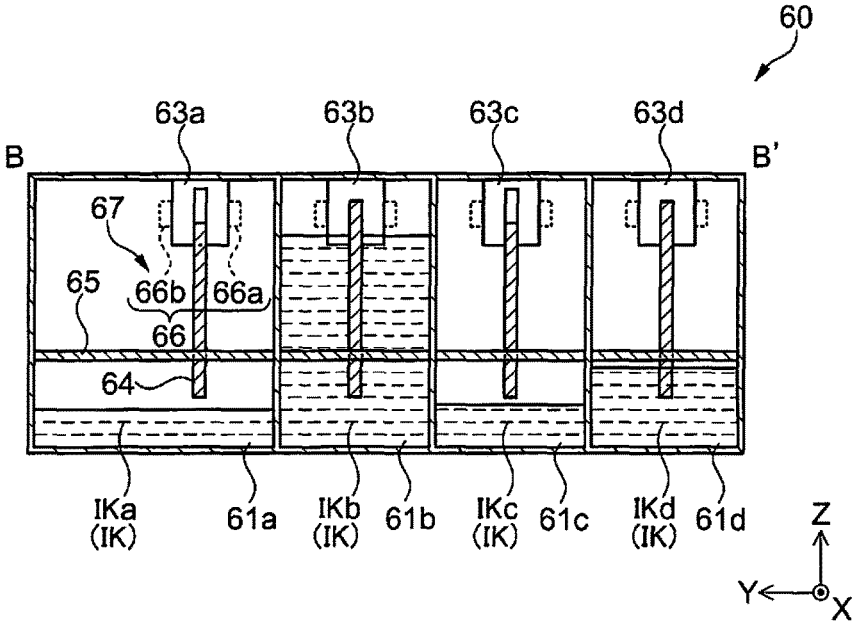
FIG. 9B is a cross-sectional view along a line B-B' in FIG. 9A.
Figure 10A:
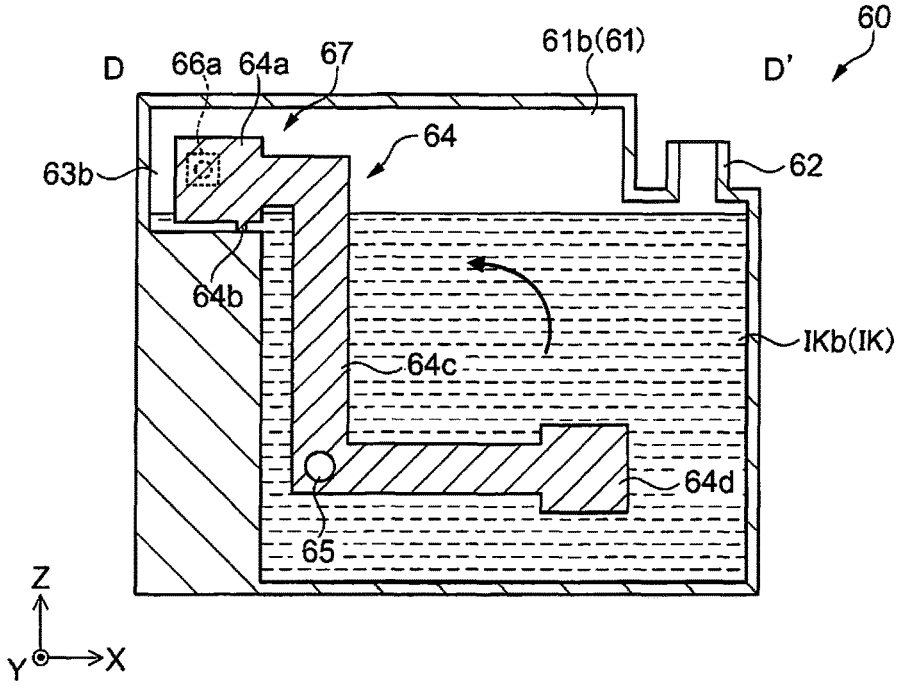
FIG. 10A is a cross-sectional view along a line D-D' in FIG. 9A.
Figure 10B:
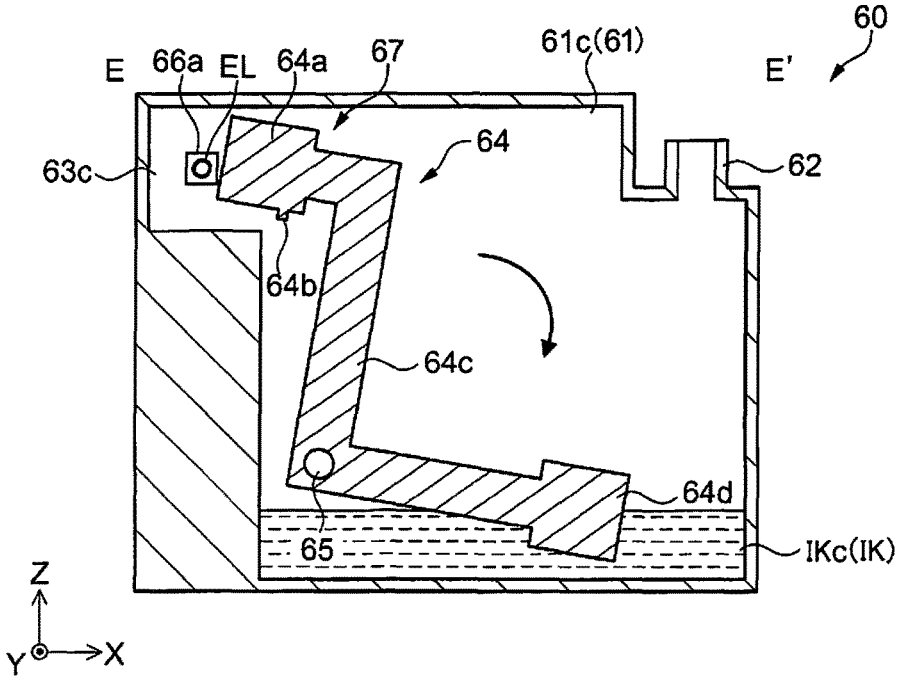
FIG. 10B is a cross-sectional view along a line E-E' in FIG. 9A.
Figure 11A:
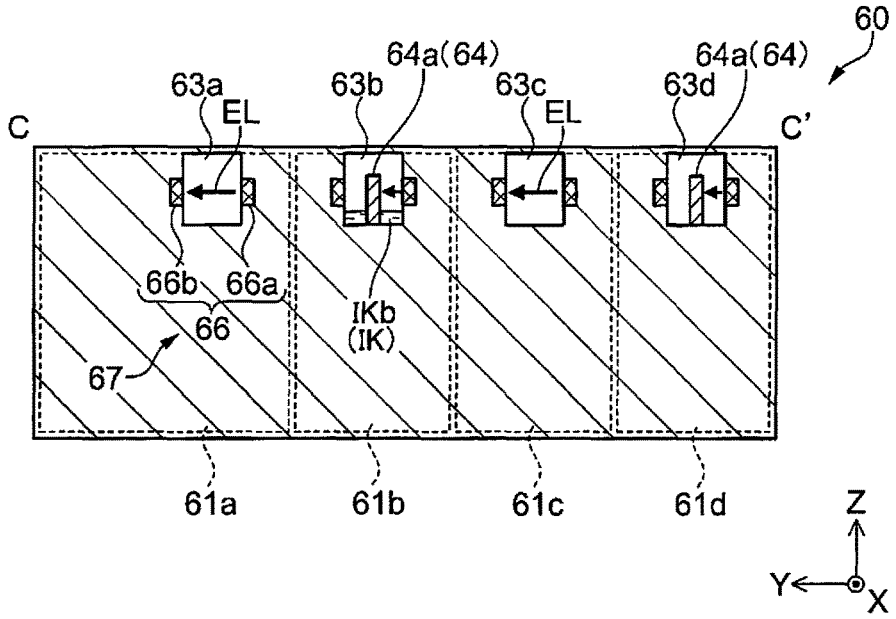
FIG. 11A is a cross-sectional view along a line C-C' in FIG. 9A.
Figure 11B:
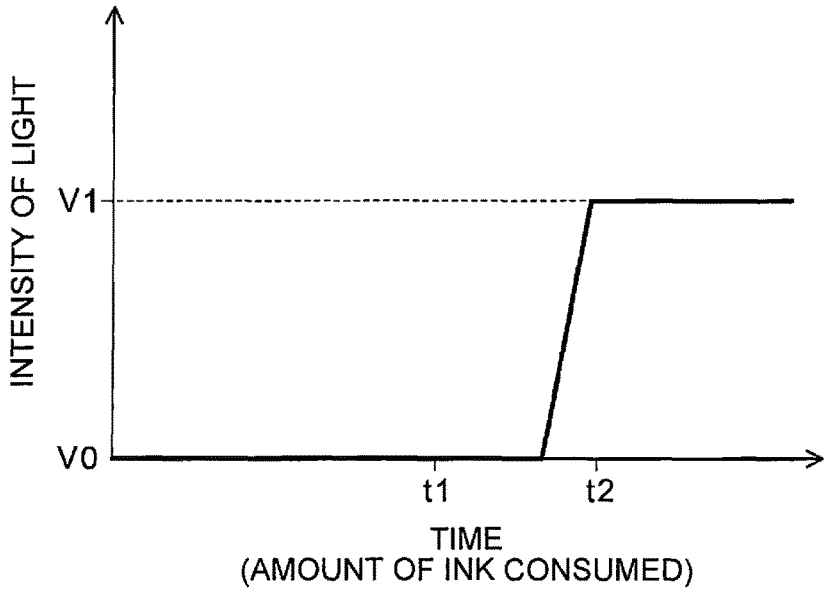
FIG. 11B is a graph showing intensity of light detected by an optical sensor in response to a decrease of ink in the ink supply unit according to the second embodiment.

FIG. 9A is a plan view schematically showing the configuration of the ink supply unit according to the second embodiment. FIG. 9B is a cross-sectional view along a line B-B' in FIG. 9A. FIG. 10A is a cross-sectional view along a line D-D' in FIG. 9A. FIG. 10B is a cross-sectional view along a line E-E' in FIG. 9A. FIG. 11A is a cross-sectional view along a line C-C' in FIG. 9A. FIG. 11B is a graph showing intensity of light detected by an optical sensor in response to a decrease of the ink in the ink supply unit according to the second embodiment. The same constituent elements as those in the first embodiment are given the same reference signs and the description thereof is omitted.

As shown in FIG. 9A, an ink supply unit 60 according to the second embodiment includes four ink tanks 61 (61*a*, 61*b*, 61*c*, and 61*d*), optical sensors 67 that each are a sensor for determining whether or not the ink IK is present at a predetermined height, a holding part 68, and a detection substrate 69. The ink tanks 61*a*, 61*b*, 61*c*, and 61*d* each have an inlet port 62, and respectively have recessed portions 63*a*, 63*b*, 63*c*, and 63*d* that are recessed in the −X direction.

The ink supply unit 60 is different from the ink supply unit 10 according to the first embodiment in the internal configurations of the four ink tanks 61*a*, 61*b*, 61*c*, and 61*d*. However, it is the same that the user can inject the ink IK contained in another container to each ink tank 61 via the corresponding inlet port 62 and refill the ink tank 61. The capacities of the four ink tanks 61*a*, 61*b*, 61*c*, and 61*d*, and the settings of the predetermined amounts C1, C2, C3, C4, and C5 and the predetermined values A and B (see FIG. 5) are also the same as in the first embodiment.

The optical sensors 67 each include a sensor part 66 that is configured with a light-emitting part 66*a* and a light-receiving part 66*b*, and a light-shielding member 64, and are respectively disposed in the ink tanks 61*a*, 61*b*, 61*c*, and 61*d*. The pairs of the light-emitting part 66*a* and the light-receiving part 66*b* respectively correspond to the recessed portions 63*a*, 63*b*, 63*c*, and 63*d*, and are respectively provided outside the ink tanks 61*a*, 61*b*, 61*c*, and 61*d*. Each pair of the light-emitting part 66*a* and the light-receiving part 66*b* are disposed so as to sandwich one of the recessed portions 63*a*, 63*b*, 63*c*, and 63*d* that corresponds thereto, and so as to oppose each other along the Y axis direction.

Each light-emitting part 66*a* is configured with an LED (Light Emitting Diode), for example, and each light-receiving part 66*b* is configured with a phototransistor, for example. Each pair of the light-emitting part 66*a* and the light-receiving part 66*b* are held by the holding part 68 and connected to the detection substrate 69 via a connector, which is not shown in the drawings. Each light-shielding member 64 is provided in one of the ink tanks 61*a*, 61*b*, 61*c*, and 61*d* corresponding thereto. In each of the ink tanks 61*a*, 61*b*, 61*c*, and 61*d*, the corresponding light-shielding member 64 is rotatably supported by a rotation shaft 65 that extends along the Y axis direction.

The cross section shown in FIG. 9B is a Y-Z cross section that is cut at the position of the rotation shaft 65 in the X axis direction shown in FIG. 9A. As shown in FIG. 9B, the recessed portions 63*a*, 63*b*, 63*c*, and 63*d* are respectively disposed on the upper sides (in the +Z direction) of the ink tanks 61*a*, 61*b*, 61*c*, and 61*d*. In FIG. 9B, it is assumed that the liquid surface levels of the inks IKb and IKd respectively contained in the ink tanks 61*b* and 61*d* are higher than or equal to a predetermined height, and the liquid surface levels of the inks IKa and IKc respectively contained in the ink tanks 61*a* and 61*c* are lower than the predetermined height.

As shown in FIG. 10A, each light-shielding member 64 has a light-shielding part 64*a*, an arm part 64*c*, and a float part 64*d*. Each arm part 64*c* has a substantially L-like shape that includes a portion that extends along the side wall of the corresponding ink tank 61 and a portion that extends along the bottom of the corresponding ink tank 61. The light-shielding part 64*a* is a member that shields light. The light-shielding part 64*a* is connected to the −X direction side of the end portion of the arm part 64*c* in the +Z direction. A protruding part 64*b* is provided below (in the −Z direction of) the light-shielding part 64*a*. The float part 64*d* is a member that has a lower specific gravity than the ink IKb (IK) and floats. The float part 64*d* is connected to the end portion of the arm part 64*c* in the −Z direction and in the +X direction.

In the ink tank 61 (61*b*), the light-shielding part 64*a* is disposed on the upper side (in the +Z direction), and the float part 64*d* is disposed on the bottom side (in the −Z direction). The light-shielding member 64 is rotatably supported by the rotation shaft 65 at the corner portion of the arm part 64*c* having a substantially L-like shape. The light-shielding member 64 may be configured with material that has a lower specific gravity than the ink IK as a whole, or formed as a hollow body that has a hollow space therein.

In the ink tank 61*b* that contains the ink IKb whose liquid surface level is higher than or equal to the predetermined height, the float part 64*d* is immersed in the ink IKb. Therefore, as indicated by an arrow shown in FIG. 10A, a force acting in the direction of floating the float part 64*d* is applied to the light-shielding member 64, and the light-shielding part 64*a* is positioned within the recessed portion 63*b*. The protruding part 64*b* comes in contact with the inner wall of the recessed portion 63*b*, and thus the light-shielding member 64 is maintained in this position until the liquid surface of the ink IKb lowers. In this position, the light-shielding part 64*a* is positioned so as to overlap the light-emitting part 66*a* in plan view from the +Y direction. When the ink IKb has been consumed and its liquid surface level becomes lower than or equal to the height of the float part 64*d*, the float part 64*d* moves downward to the bottom of the ink tank 61*b* (in the −Z direction) as the liquid surface lowers.

As shown in FIG. 10B, in the ink tank 61*c* in which the liquid surface level of the ink IKc has become lower than the predetermined height, the light-shielding member 64 rotates in the direction indicated by the arrow shown in FIG. 10B as the float part 64*d* moves downward to the bottom (in the −Z direction). Consequently, the light-shielding part 64*a* moves in the +X direction, and thus the light-shielding part 64*a* is positioned so as not to overlap the light-emitting part 66*a* in plan view from the +Y direction.

Note that in FIG. 9B, in the ink tank 61*d* in which the liquid surface level of the ink IKd is higher than or equal to the predetermined height, the light-shielding part 64*a* is positioned so as to overlap the light-emitting unit 66*a* in the plan view from the +Y direction as with the ink tank 61*b* shown in FIG. 10A. In the ink tank 61*a* in which the liquid surface level of the ink IKa is lower than the predetermined height, the light-shielding part 64*a* is positioned so as not to overlap the light-emitting unit 66*a* in the plan view from the +Y direction as with the ink tank 61*c* shown in FIG. 10B.

The cross section shown in FIG. 11A is a Y-Z cross section that is cut at the position of the sensor part 66 in the X axis direction shown in FIG. 9A. As shown in FIG. 11A, in each of the ink tanks 61*b* and 61*d* in which the liquid surface levels of the inks IKb and IKd are higher than or equal to the predetermined height, the light EL emitted from the light-emitting unit 66*a* is shielded by the light-shielding part 64*a*, and is not received by the light-receiving unit 66*b*. On the other hand, in each of the ink tanks 61*a* and 61*c* in which the liquid surface levels of the inks IKa and IKc are lower than the predetermined height, the light EL emitted from the light-emitting unit 66*a* is received by the light-receiving unit 66*b* without being shielded by the light-shielding part 64*a*.

FIG. 11B is a diagram showing changes in the intensity of the light EL that is received by the light-receiving unit 66*b* in response to changes in the position of the light-shielding member 64 from the state shown in FIG. 10A to the state shown in FIG. 10B. The horizontal axis in FIG. 11B indicates time (corresponding to the amount of the ink IK consumed), and the vertical axis indicates the intensity of the light EL received by the light-receiving unit 66*b*. Note that the intensity of the light EL received by the light-receiving unit 66*b* is calculated based on, for example, the output voltage that is output according to the amount of the light received by the light-receiving unit 66*b*.

A time point corresponding to the state shown in FIG. 10A is referred to as t1 and a time point corresponding to the state shown in FIG. 10B is referred to as t2. V0 denotes the intensity of light during the period in which the light-receiving unit 66*b* does not receive the light EL, and V1 denotes the intensity of the light during the period in which the light-receiving unit 66*b* receives the light EL. At t1, the light EL is shielded by the light-shielding part 64*a* and is not received by the light-receiving unit 66*b*, and therefore the intensity of the light is V0. At t2, which is after the ink IK has been consumed over time, the light EL is received by the light-receiving unit 66*b*, and therefore the intensity of the light becomes V1. When the intensity of the light is V1, the control unit 40 (liquid surface lowering determination unit 43) detects the "sensor end".

As described above, in the second embodiment, whether or not the ink IK is present at the predetermined height from the bottom of the ink tank 61 is determined based on differences in the intensity of the light EL emitted by the light-emitting unit 66*a* and received by the light-receiving unit 66*b* included in the optical sensor 67. In the second embodiment, as in the first embodiment, the control unit 40 determines whether or not the ink IK is present at the predetermined height in the ink tank 61, and sets the sensor end flag 55 in the storage unit 50 for the ink tank 61 for which the sensor end has been detected, and starts counting the post-sensor end ink consumption amount. Since the same ink remaining amount management as that in the first embodiment is performed in the second embodiment, it is possible to continuously use the printer without paying careful attention to, for example, the timing of refilling the liquid container with the liquid, the amount of the liquid with which the liquid container is refilled, and the input operation, and it is possible to reduce the risk of idle injection occurring under such usage conditions.

The above-described embodiments merely show certain aspects of the invention, and may be modified or applied in any manner within the scope of the invention. For example, the following modifications are possible.

Modification 1

In the embodiments above, the refill ink IK is provided in the state of being contained in a refill bottle, the capacity of the refill bottle is smaller than the maximum consumable capacity of the ink tanks 11 and 61, and the full amount of the ink IK contained in the refill bottle can be contained in the ink tanks 11 and 61. However, the invention is not limited to such embodiments. For example, the capacity of the refill bottle may be greater than the maximum consumable capacity of the ink tanks 11 and 61, and the refill ink IK may be provided in the state of being contained in a bag-like container instead of a bottle-like container.

As described above, in the printer 110, the control unit 40 detects the ink low and the ink end based on the count value counted since when the sensor end was detected by ink presence/absence detection with sensors, and it is therefore possible to precisely detect the ink low and the ink end even if the user repeatedly refills the ink tank with the ink IK. Therefore, as long as the user is careful not to overflow the ink IK from the ink tanks 11 and 61 when refilling the ink tank, the user can use the printer 110 without causing the idle injection state, even if the user does not pay attention to details such as the timing of refilling the ink tanks 11 and 61 with the ink IK and the amount of the refill ink.

Modification 2

In the embodiments above, a configuration is adopted in which the sensors 19 or the optical sensors 67 are provided as sensors, and whether the ink IK is present at the predetermined height in the ink tanks 11 and 61 is determined. However, the invention is not limited to such embodiments. The sensors are not limited to sensors that determine whether or not the ink IK is present at the predetermined height in the ink tanks 11 and 61, and may be sensors that determine whether or not the amount of the ink IK remaining in the ink tanks 11 and 61 is a predetermined amount. For example, a configuration may be adopted in which a weight sensor is provided and whether or not the amount of the ink IK remaining in the ink tanks 11 and 61 is determined based on differences in the weight.

Modification 3

In the embodiments above, the printer system 100 that is a multifunction peripheral provided with the printer 110, which serves as a liquid consumption apparatus, and the scanner 120, is taken as an example and a description is given thereof. However, the invention is not limited to such embodiments. The liquid consumption apparatus may be a single function printer 110 that does not include the scanner 120.

Modification 4

In the embodiments above, a description is given of an example in which the invention is applied to a printer and ink tanks. However, the invention is not limited to such embodiments. For example, the invention may be used in a liquid consumption apparatus that injects or discharges a liquid other than ink, and may also be applied to a liquid container that contains such a liquid.

Modification 5

In the embodiments above, whether or not the user has selected "execution of reset" is determined in step S34 shown in FIG. 8. However, the invention is not limited to such embodiments. Instead of "EXECUTION OF RESET", "INK TANK REFILLED WITH INK?" may be displayed as a message for prompting the user to make a selection in step S34.

The entire disclosures of Japanese Patent Applications No. 2015-59176, filed on Mar. 23, 2015, and No. 2015-234474, filed on Dec. 1, 2015, are expressly incorporated herein by reference.

What is claimed is:

1. A liquid consumption apparatus comprising:

a liquid supply unit including a case and a liquid container that contains a liquid, is fixed to the case, and has an inlet port through which the liquid is configured to be refilled, the case containing the liquid container such that the inlet port is exposed to the outside of the case;

a consumption amount calculation unit that calculates a consumption amount of the liquid;

a storage unit that stores therein a count value that is updated based on the consumption amount of the liquid calculated by the consumption amount calculation unit;

a sensor that detects whether or not the liquid is present at a predetermined position in the liquid container, the sensor including a pair of electrodes that are disposed inside the liquid container, one of the pair of electrodes being longer than an other of the pair of electrodes;

a control unit that executes liquid presence/absence detection with the sensor to determine whether or not the liquid is present, and executes reset processing to reset the count value to an initial value thereof; and a sensor end flag that is set up in response to the control unit determining that the liquid is not present by executing the liquid presence/absence detection, after the sensor end flag is set up and before resetting the count value, the control unit executing the liquid presence/absence detection in response to determining a post-sensor end count value is greater than or equal to a first predetermined value, the post-sensor end count value being a count counted since the control unit lastly determines that the liquid is present before the sensor end flag is set up, and the control unit resetting the count value in response to determining that the liquid is present by executing the liquid presence/absence detection.

2. The liquid consumption apparatus according to claim 1, wherein the control unit executes the reset processing if the control unit determines that the liquid is present by executing the liquid presence/absence detection and the count value is greater than or equal to a value that corresponds to a capacity of the liquid container.

3. The liquid consumption apparatus according to claim 1, further comprising:

a user interface unit that includes a display unit that displays a message to the user, wherein the control unit generates first data and outputs the first data to the user interface unit during a period from when the control unit executes the reset processing to when the control unit determines that the liquid is not present by executing the liquid presence/absence detection, the first data being for displaying a first message that prompts the user to check an amount of the liquid remaining in the liquid container, and the user interface unit displays the first message on the display unit based on the first data that is output from the control unit.

4. The liquid consumption apparatus according to claim 3, wherein the user interface unit is capable of receiving, from the user, an input that indicates the user's intention to refill the liquid container with the liquid, and the control unit executes the reset processing if the control unit determines that the liquid is present by executing the liquid presence/absence detection after the user interface unit receives the input that indicates the user's intention to refill the liquid container with the liquid.

5. The liquid consumption apparatus according to claim 1, further comprising:

a user interface unit that includes a display unit and is capable of receiving, from the user, an input that indicates the user's intention to refill the liquid container with the liquid, the display unit displaying a message to the user, wherein in a case where: the sensor end flag is set up; the post-sensor end count value is greater than or equal to a first predetermined value; and the control unit determines that the liquid is not present by executing the liquid presence/absence detection, the control unit stops an operation that consumes the liquid when the post-sensor end count value becomes greater than or equal to a sum of the first predetermined value and a second predetermined value, and the control unit executes the reset processing and enables the operation that consumes the liquid if the control unit determines that the liquid is present by executing the liquid presence/absence detection after stopping the operation that consumes the liquid and after the user interface unit receives the input that indicates the user's intention to refill the liquid container with the liquid.

6. The liquid consumption apparatus according to claim 5, wherein the control unit generates second data and outputs the second data to the user interface unit if the post-sensor end count value is greater than or equal to the first predetermined value and the control unit determines that the liquid is not present by executing the liquid presence/absence detection, the second data being for displaying a second message that prompts the user to refill the liquid container with the liquid, and the user interface unit displays the second message on the display unit based on the second data that is output from the control unit.

7. The liquid consumption apparatus according to claim 5, wherein the liquid with which the user refills the liquid container is contained in a refill container that is separate from the liquid consumption apparatus, and an amount of the liquid that can be contained in the liquid container when the post-sensor end count value is greater than or equal to the first predetermined value is greater than or equal to a capacity of the refill container.

8. The liquid consumption apparatus according to claim 1, wherein the control unit executes the liquid presence/absence detection and updates the count value every time a predetermined amount of the liquid is consumed.

9. The liquid consumption apparatus according to claim 1, further comprising:

a plurality of liquid containers that respectively contain a plurality of types of liquids, wherein the consumption amount calculation unit calculates, for each liquid container, the consumption amount of the corresponding liquid, the storage unit stores the count value for each liquid container, each count value being independently updated based on the consumption amount of the corresponding liquid, the sensor is provided for each liquid container, and the control unit executes the liquid presence/absence detection for each liquid container before resetting the corresponding count value to the initial value thereof.

10. The liquid consumption apparatus according to claim 1, wherein the control unit determines whether or not the liquid is present at the predetermined position in the liquid container based on a value of resistance between the pair of electrodes.

11. The liquid consumption apparatus according to claim 1, wherein the sensor is configured with: a light-shielding member that is disposed inside the liquid container and moves according to an amount of the liquid in the liquid container; and a light-emitting part and a light-receiving part that are disposed outside the liquid container, and the control unit determines whether or not the liquid is present at the predetermined position in the liquid container based on an intensity of light that is emitted from the light-emitting part and is received by the light-receiving part.

* * * * *